US008870280B2

(12) United States Patent
Dehli

(10) Patent No.: US 8,870,280 B2
(45) Date of Patent: Oct. 28, 2014

(54) TABLE ACCESSORY FOR A CHAIR

(75) Inventor: Hans Dehli, San Clemente, CA (US)

(73) Assignee: Human Touch, LLC, Long Beach, CA (US)

( * ) Notice: Subject to any disclaimer, the term of this patent is extended or adjusted under 35 U.S.C. 154(b) by 277 days.

(21) Appl. No.: 13/306,932

(22) Filed: Nov. 29, 2011

(65) Prior Publication Data

US 2013/0134744 A1 May 30, 2013

(51) Int. Cl.
*A47B 83/02* (2006.01)
*A47B 37/00* (2006.01)

(52) U.S. Cl.
USPC ..... 297/173; 108/50.11

(58) Field of Classification Search
USPC ..... 297/173, 170, 354.12, 411.35
See application file for complete search history.

(56) References Cited

U.S. PATENT DOCUMENTS

| | | | | |
|---|---|---|---|---|
| 137,069 | A * | 3/1873 | Goss | 297/354.12 |
| 289,384 | A * | 12/1883 | Byrkit | 248/454 |
| 5,605,311 | A * | 2/1997 | McGrath et al. | 248/118 |
| 6,145,800 | A * | 11/2000 | Watkins | 248/461 |
| 7,478,867 | B2 * | 1/2009 | Weng | 297/161 |
| D655,532 | S | 3/2012 | Saelid | |
| 2008/0121763 | A1 * | 5/2008 | Mori et al. | 248/68.1 |

FOREIGN PATENT DOCUMENTS

| | | | |
|---|---|---|---|
| WO | WO 2011/049458 | A1 | 4/2011 |
| WO | WO 2011/049460 | A1 | 4/2011 |

OTHER PUBLICATIONS

Stressless PC-table; http://www.ekornes.com/us/stressless-recliners/tables/stressless-pc-table, 1 sheet, Dated Jun. 12, 2014.
Photograph of Ecornes Laptop Table, 1 sheet.
Catalog Page of Stressless Royal Chair, 1 sheet.
Advertisement from www.horizontalcomputing.com, 1 sheet.

* cited by examiner

*Primary Examiner* — Milton Nelson, Jr.
(74) *Attorney, Agent, or Firm* — Christie, Parker & Hale, LLP

(57) ABSTRACT

A fully articulable table apparatus for personal use is configured for attachment to a chair, such as a recliner chair. In one embodiment, the table apparatus has a mounting bracket configured to attach to the chair and a mounting post configured to attach to the mounting bracket. The table apparatus also includes an elbow that has a vertical leg configured to rotatably connect to the mounting post. The table apparatus also includes a swing arm having an outer circumferential notch formed on a proximal end of the swing arm which is configured to rotatably connect to a horizontal leg of the elbow. The table apparatus also includes a hinge configured to rotatably connect to a distal end of the swing and a table portion configured to rotatably connect to the hinge.

22 Claims, 25 Drawing Sheets

15C
15C
36
41
40
38
42
23
50
37
23
51
37
50
36
41
39
23
36
41
36
38
37
45

FIG.16A
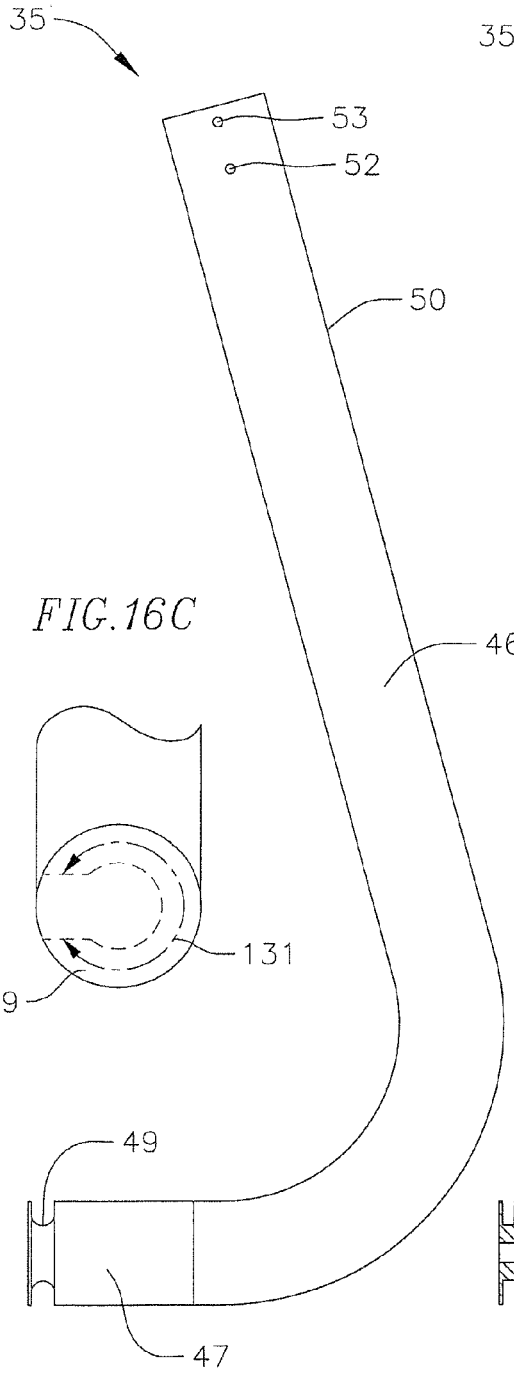
FIG.16B
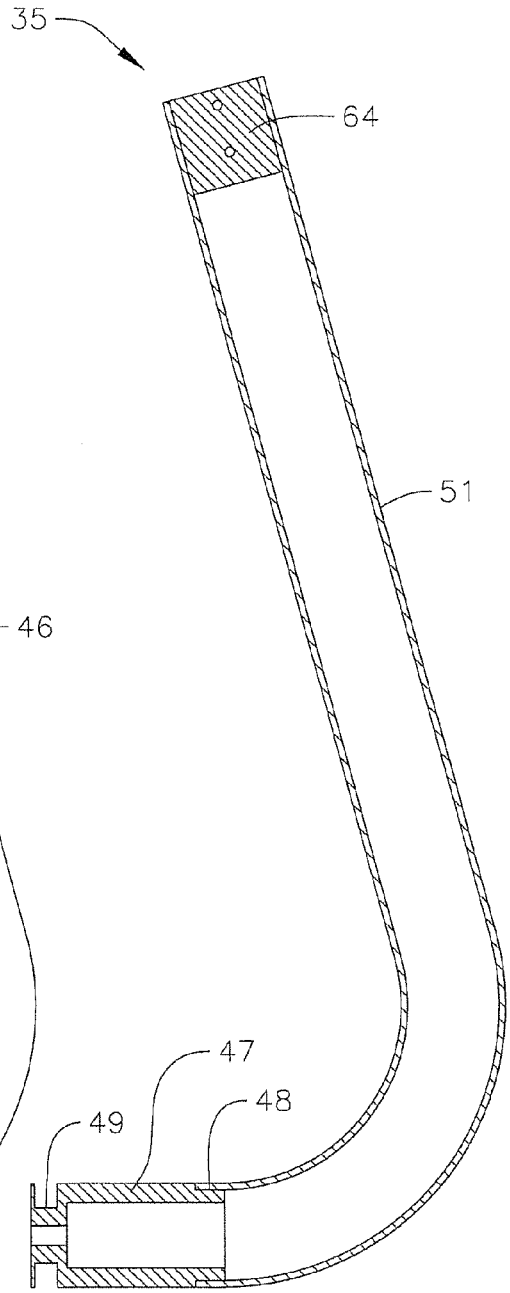
FIG.16C

TABLE ACCESSORY FOR A CHAIR

TECHNICAL FIELD

Aspects of embodiments of the present invention relate to a table, and more particularly, to an articulable table for a reclinable chair.

BACKGROUND

Reclinable chairs are commonly used for providing a more comfortable or ergonomic position to the back and/or legs of a user while the user is seated. Typically, reclinable chairs are used in a home, but may also be used in an office or other location. For example, during rehabilitation, a worker may be able to work more efficiently in a reclined position. As such, a user of a reclinable chair may wish to use a laptop computer ("laptop") while seated in the chair. However, it may be difficult or uncomfortable to use a laptop while seated in a typical reclinable chair because a typical reclinable chair does not have a table for supporting a laptop, and, therefore, a user would likely place the laptop in his or her lap or balance the laptop on an armrest of the chair.

As such, there is a need for a laptop table for a reclinable chair that is easily adjusted according to a reclined or unreclined position of the chair. Further, there is a need for a laptop table that is easily configured according to a height or seating position of a user.

SUMMARY

The present invention is directed to a fully articulable table apparatus for personal use which is configured for attachment to a chair, such as a recliner chair. According to an embodiment of the present invention, the table apparatus includes a mounting bracket having a swing axis, wherein the mounting bracket is configured to attach to the chair. A swing arm having a proximal end is configured to rotatably connect to the mounting bracket about the swing axis. A hinge is configured to rotatably connect to the swing arm about a swivel axis extending through a distal end of the swing arm. Moreover, a table portion is configured to rotatably connect to the hinge about the pitch axis which is substantially orthogonal to the swivel axis. In a further embodiment, a mounting post is configured to connect the swing arm to the mounting bracket. In a more detailed embodiment, a vertical leg of an elbow is configured to rotatably attach to the mounting post about the swing axis. In another detailed embodiment, the proximal end of the swing arm comprises an outer circumferential notch configured to rotatably connect to a horizontal leg of the elbow.

According to an aspect of embodiments of the present invention, the table portion is adapted to rotate about the swing axis to permit ingress and egress into the chair and to permit movement of the table portion into the desired position for work tasks. In another aspect of embodiments of the present invention, the table portion is adapted to rotate about the pitch axis toward or away from the user to permit the user to achieve, for example, the appropriate viewing angle of a laptop screen when the chair is in either a reclined or unreclined position. According to another aspect of embodiments of the present invention, the table portion is adapted to rotate about the swivel axis to permit alignment of the table portion with the position of the user in the chair. In a further aspect, the level of the table portion is adjustable to permit a user to compensate for the weight of an object, such as a laptop, on the table portion which tends to deflect the table portion downward. As a safety feature, the table portion is adapted to rotate past the level set by the user in order to prevent pinning the user's legs between the chair and the table apparatus if the chair is inadvertently reclined and the user's legs are forced upwards into the table apparatus.

Additionally, the overall height of the table portion is adjustable by sliding one or more spacer rings onto the mounting post in order to increase or decrease the usable space between the table portion and the chair and thereby accommodate the specific body type of the user. The user's laptop is securable to the table portion by edge stop assemblies positionable on the table portion. Furthermore, the mounting post is configured to permit the connection of various utility devices, such as a lamp, a secondary monitor, or a glass holder. Moreover, the user's laptop cables are safely and conveniently fixedly positionable away from the rotatable members by securing the cables to at least one cable management clip attached to the swing arm.

Additional aspects and/or advantages of embodiments of the present invention are set forth in the following description and accompanying drawings, or may be obvious in view thereof to those skilled in the art.

BRIEF DESCRIPTION OF THE DRAWINGS

The above and other features and advantages will become more apparent to those of ordinary skill in the art by describing in detail some exemplary embodiments of the present invention with reference to the attached drawings, in which:

FIGS. 16A, 16B, and 16C are a top view, cross-sectional view, and a side view of the swing arm assembly, respectively;

DETAILED DESCRIPTION

Some exemplary embodiments will now be described more fully hereinafter with reference to the accompanying drawings; however, embodiments of the present invention may be embodied in different forms and should not be construed as limited to the exemplary embodiments illustrated and set forth herein. Rather, these exemplary embodiments are provided by way of example for understanding of the invention and to convey the scope of the invention to those skilled in the art.

Figure 1:
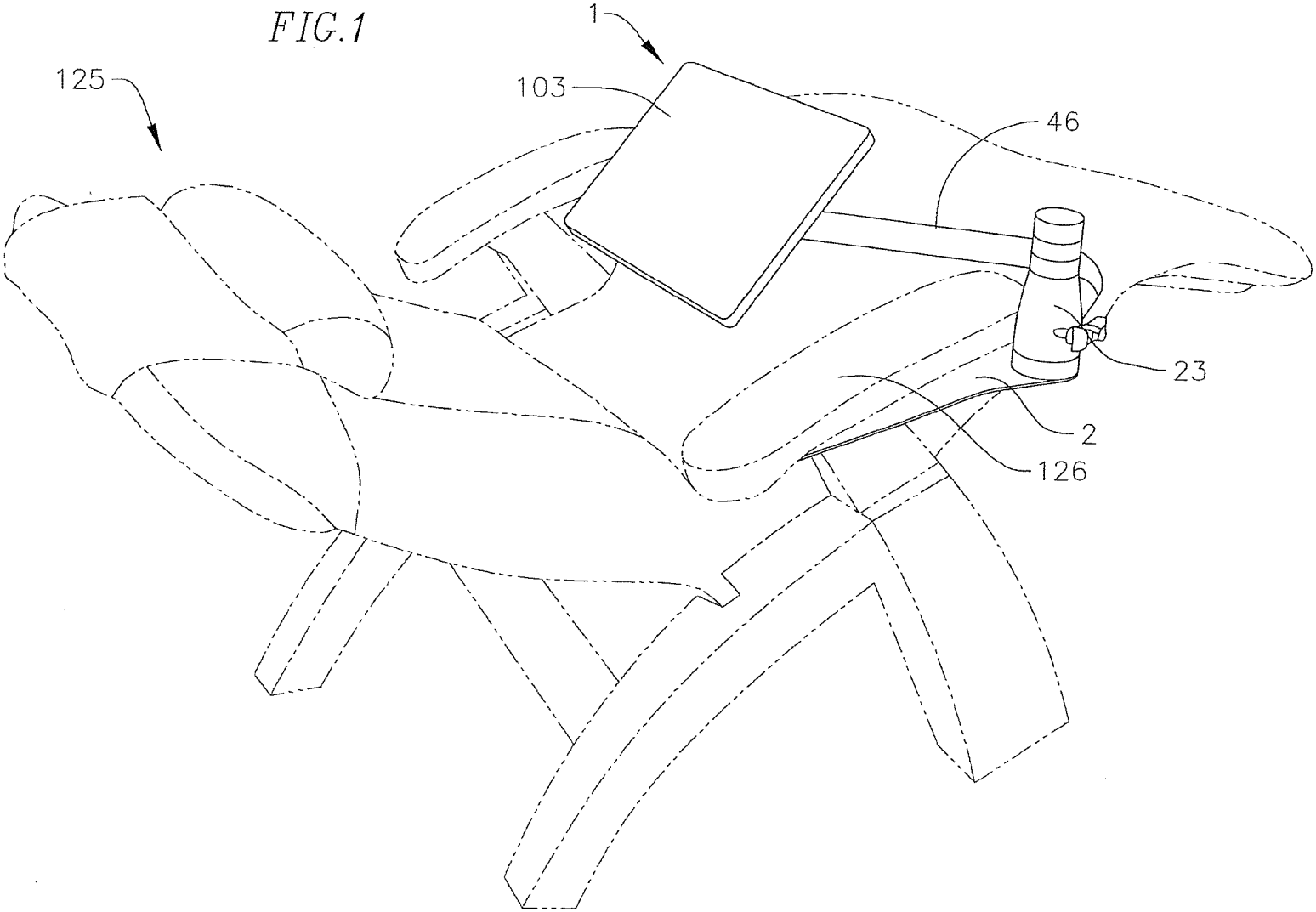
FIG. 1 is a perspective view of a laptop table assembly mounted to a recliner chair according to an embodiment of the present invention.

With reference to FIG. 1, a laptop table assembly 1 is connected to an armrest support 126 of a recliner chair 125. FIGS. 5, 6, 7, 8, and 9 illustrate an embodiment of the laptop table assembly 1 with multiple components that are rotatably or hingedly connected to each other. The laptop table assembly 1 comprises a laptop table 103 (FIGS. 5, 6, 7, 8, and 9) configured to adjustably mount on a hinge 75 (FIGS. 6, 8, and 9), a swing arm 46 (FIGS. 5, 6, 7, 8, and 9) configured to rotatably attach to the hinge 75 and a horizontal leg 37 of an elbow 23 (FIGS. 5, 6, 7, 8, and 9), and a mounting post 8 (FIG. 9) configured to rotatably attach to a vertical leg 36 of the elbow 23 and fixedly attach to a mounting bracket 2 (FIGS. 5, 6, 7, 8, and 9), which in turn is configured to attach to the recliner chair 125.

Figure 10B:
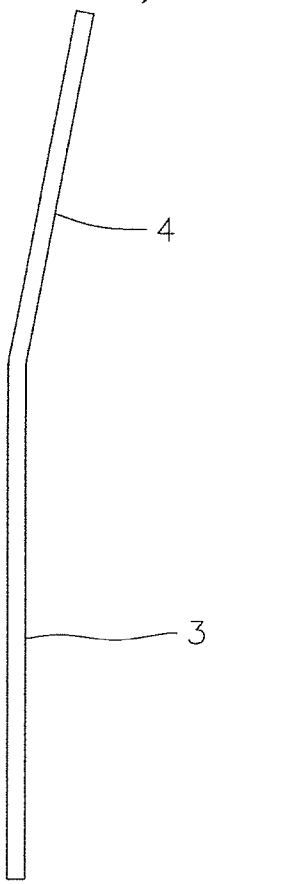
FIGS. 10A and 10B are a top view and a side view of the mounting bracket, respectively.
Figure 10A:
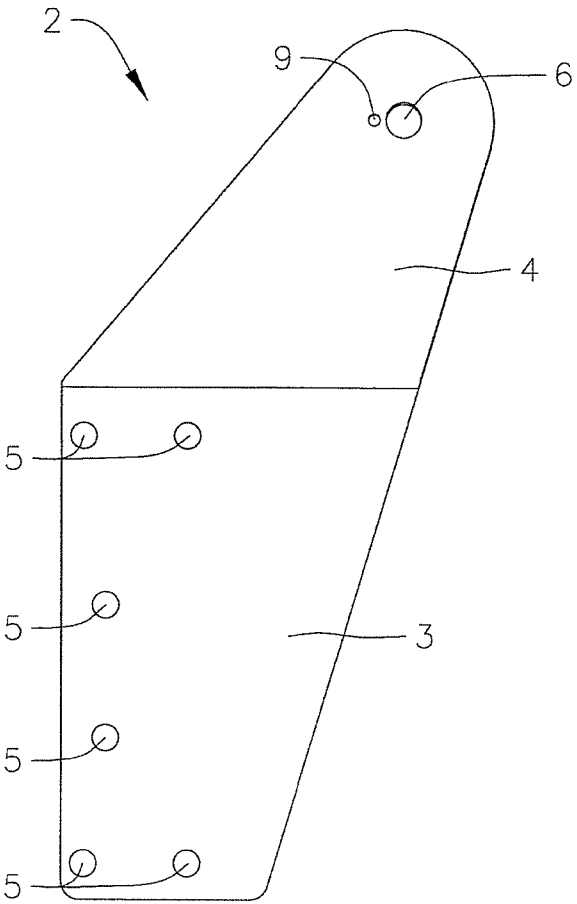
Figure 11A:
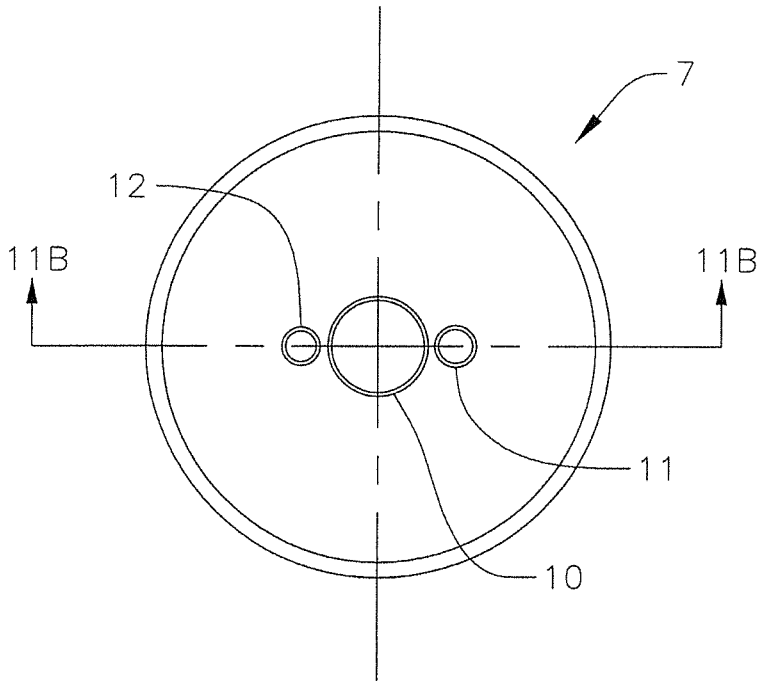
FIGS. 11A and 11B are a top view and a cross-sectional view of the spacer plate, respectively.
Figure 11B:
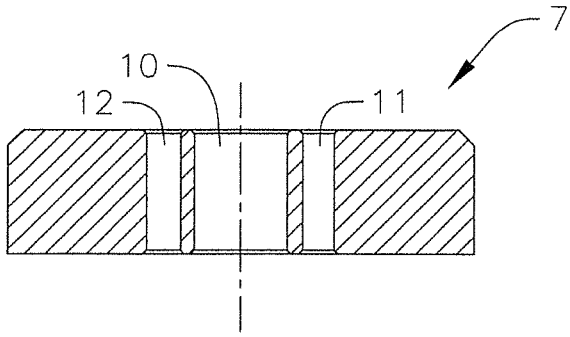

As shown in FIGS. 10A and 10B, the mounting bracket 2 contains two flat plate segments 3, 4 disposed at an angle relative to each other. The first flat plate segment 3 contains a pattern of holes 5 configured to align with preexisting holes (not shown) in the armrest support 126 of the recliner chair 125. The mounting bracket 2 is secured to the recliner chair 125 by any suitable means, for example, a plurality of screws (not shown) extending through the holes 5 in the mounting bracket 2 and into the preexisting holes in the armrest support 126. With continued reference to FIG. 10, the second flat plate segment 4 contains a hole 6 for attaching a spacer plate 7 and the mounting post 8 to the mounting bracket 2. The second flat plate segment 4 also contains a pin hole 9 adjacent to the hole 6 for fixing the angular position of the spacer plate 7 relative to the mounting bracket 2.

Figure 9:
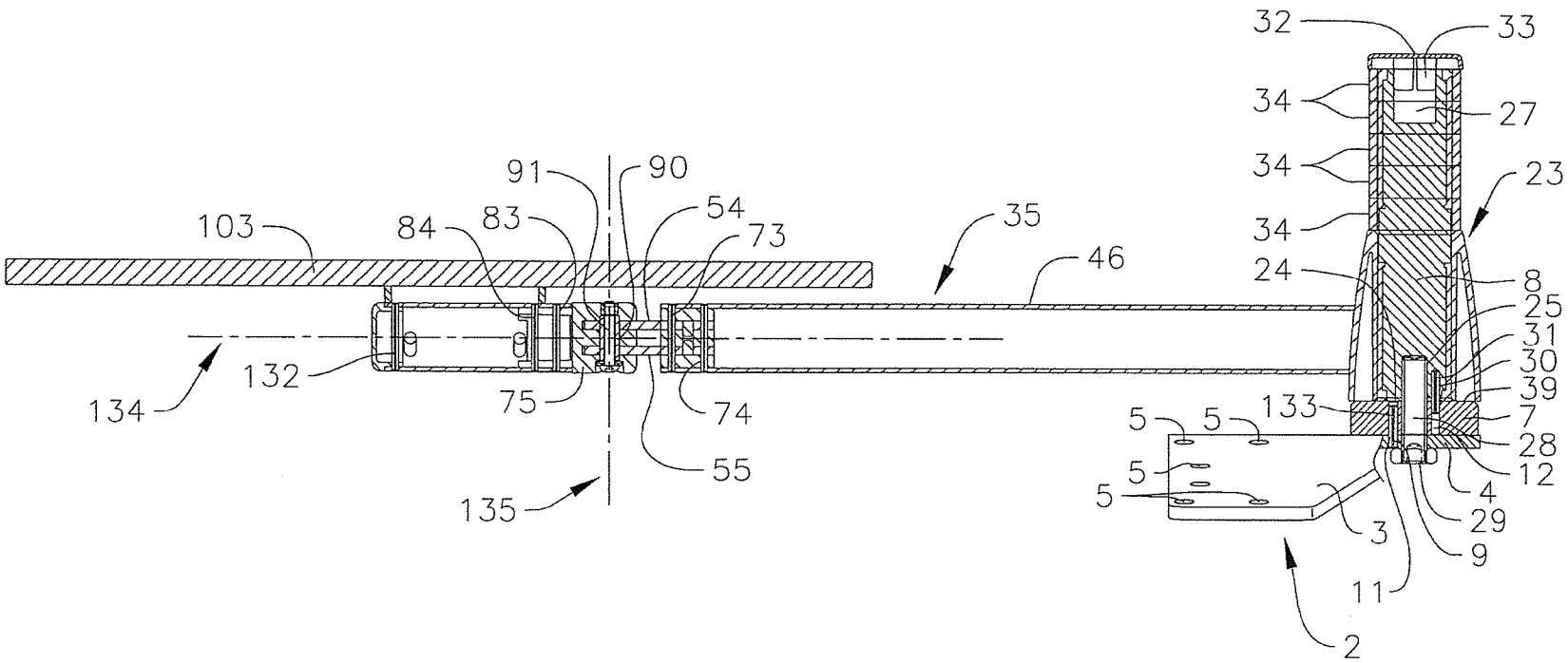
FIG. 9 is a cross-sectional view of the laptop table assembly.

As shown in FIGS. 6, 7, 9, 11A, and 11B, the spacer plate 7 is provided to mount the mounting post 8 to the mounting bracket 2. The spacer plate 7 is a flat disk containing an axial smooth bore 10 configured to align with the hole 6 in the mounting bracket 2. The spacer plate 7 also contains two off-axis pin holes 11, 12 adjacent to the hole 6, which are configured to prevent the spacer plate 7 and mounting post 8, respectively, from rotating about their longitudinal axes. As illustrated in FIG. 9, the angular position of the spacer plate 7 is fixed by aligning an off-axis pin hole 11 in the spacer plate 7 with the pin hole 9 in the mounting bracket 2 and by inserting any suitable mechanical fastener, such as an anti-rotation pin 133, through the off-axis pin hole 11 in the spacer plate 7 and the pin hole 9 in the mounting bracket 2. In an alternative embodiment, the angular position of the spacer plate 7 is fixed to the mounting bracket 2 by a countersunk head rivet (not shown) extending through the off-axis pin hole 11 and the pin hole 9.

Figure 12A:
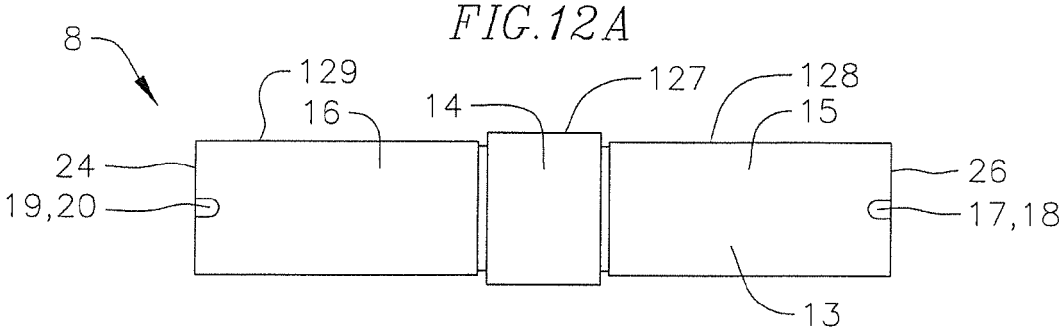
FIGS. 12A, 12B, and 12C are a side view, bottom view, and a cross-sectional view of the mounting post, respectively.
Figure 12B:
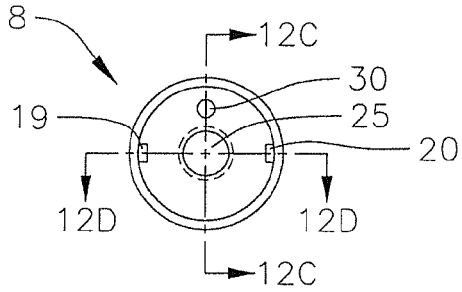
Figure 12C:
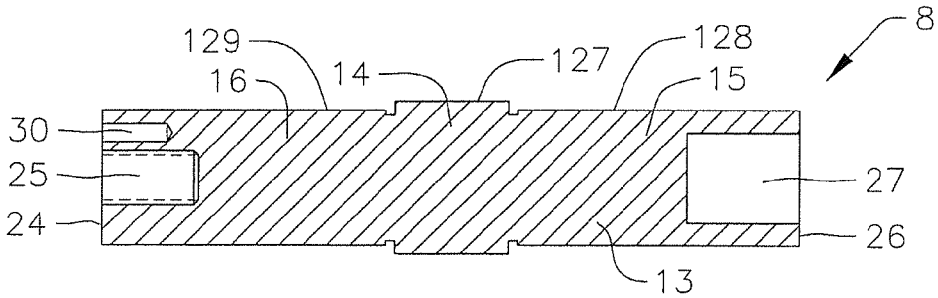
Figure 12D:
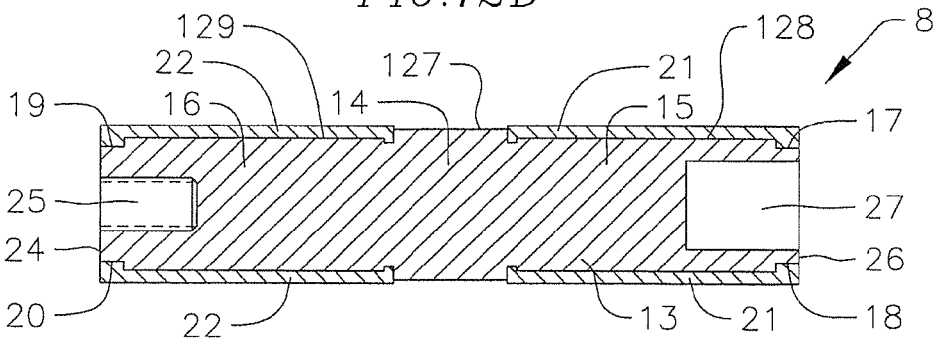
FIG. 12D is a cross-sectional view of the mounting post along with the molding.
Figure 13A:
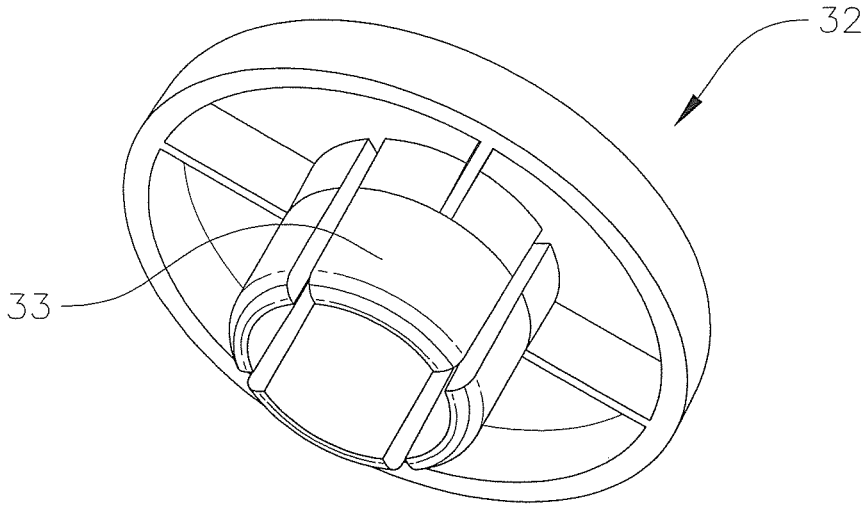
FIGS. 13A and 13B are a perspective view and a side view of the top cap, respectively.
Figure 13B:
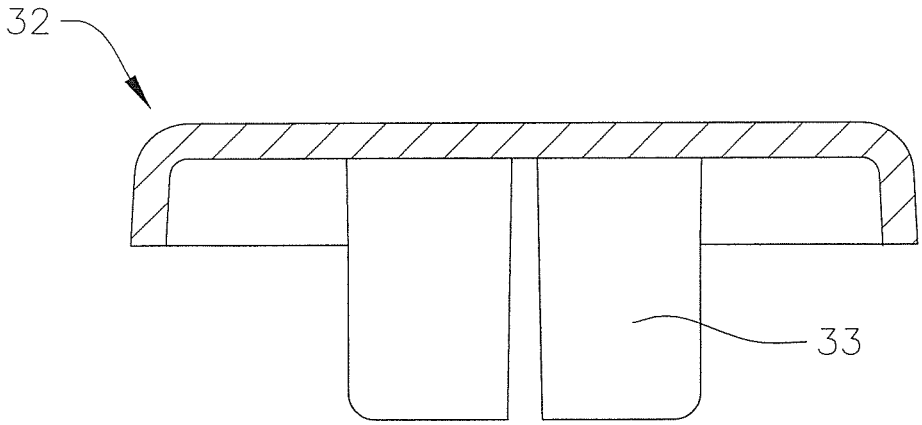

Referring now to FIGS. 12A, 12B, 12C, and 12D, a mounting post 8 comprises a rod 13 having an outer diameter 127 that is largest in a central portion 14 of the mounting post 8 and outer diameters 128, 129 that are smaller at upper and lower portions 15, 16, respectively, of the mounting post 8. The upper and lower portions 15, 16 of the mounting post 8 each contain two outer circumferential notches 17, 18, 19, and 20. As illustrated in FIG. 12D, moldings 21, 22 are attached to the upper and lower portions 15, 16, respectively, of the mounting post 8 and extend into the outer circumferential notches 17, 18, 19, and 20. The moldings 21, 22 are applied to the upper and lower portions 15, 16 of the mounting post 8 by any suitable means, such as dipping, spraying, press fitting, or bonding. The outer circumferential notches 17, 18, 19, 20 prevent the moldings 21, 22 from rotating about the longitudinal axis of the mounting post 8 and thereby disengaging the mounting post 8. The moldings 21, 22 advantageously protect the mounting post 8 and the elbow 23, described in detail below, against premature wear which would otherwise result from the rotational contact between the elbow 23 and the mounting post 8.

With continued reference to FIGS. 12B, 12C, and 12D, a bottom surface 24 of the mounting post 8 contains an internally threaded blind bore 25 and a top surface 26 of the mounting post 8 contains a smooth blind bore 27. With additional reference to FIG. 9, an externally threaded shaft 28 connects the mounting post 8 to the spacer plate 7 and the mounting bracket 2. The externally threaded shaft 28 engages the internally threaded blind bore 25 and protrudes downward from the bottom surface 24 of the mounting post 8. The externally threaded shaft 28 is configured to extend through the smooth bore 10 in the spacer plate 7 and the hole 6 in the mounting bracket 2. The length of the portion of the externally threaded shaft 28 extending past the bottom surface 24 of the mounting post 8 sufficiently exceeds the combined thickness of the spacer plate 7 and the mounting bracket 2 to permit a self-locking hex nut 29 to engage the externally threaded shaft 28 and secure the mounting post 8 to the spacer plate 7 and the mounting bracket 2. In an alternative embodiment, a hex bolt having a grip length substantially equal to the combined thickness of the spacer plate 7 and the mounting bracket 2 may be used instead of the externally threaded shaft 28 and the self-locking hex nut 29.

Referring again to FIGS. 9, 12B, 12C, and 12D, the bottom surface 24 of the mounting post 8 contains an off-axis blind hole 30. The off-axis blind hole 30 is configured to align with the other off-axis pin hole 12 in the spacer place 7, and any suitable attachment member, such as an anti-rotation pin 31, is inserted into the off-axis blind hole 30 in the mounting post 8 and the off-axis pin hole 12 in the spacer plate 7 in order to prevent the mounting post 8 from rotating about its longitudinal axis. Otherwise, such longitudinal rotation of the mounting post 8 would cause the hex nut 29 securing the mounting post 8 and the spacer plate 7 to the mounting bracket 2 to disengage the externally threaded shaft 28.

Figure 6:
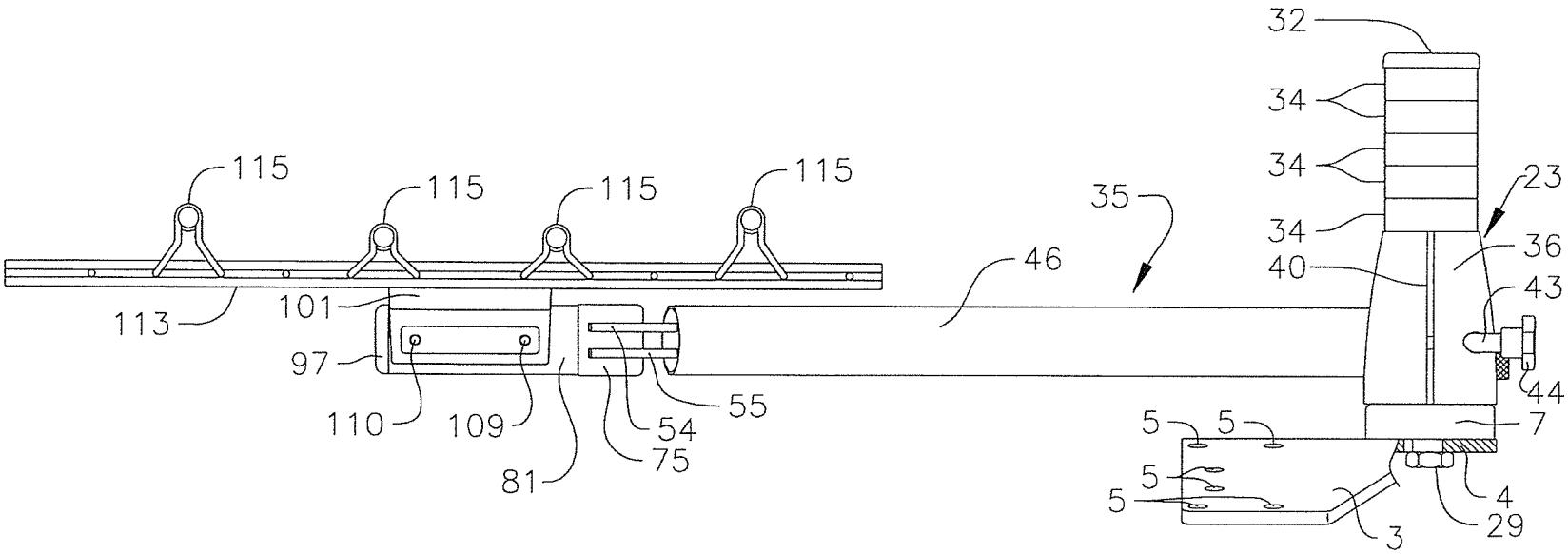
FIG. 6 is a back view of the laptop table assembly.
Figure 7:
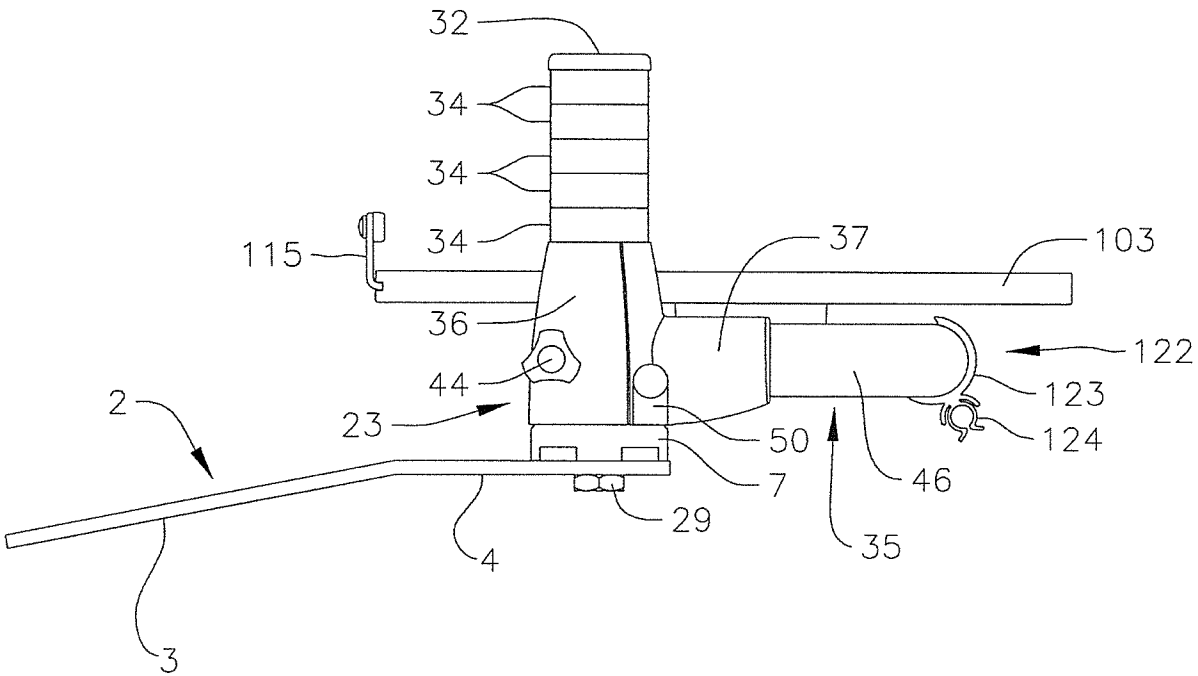
FIG. 7 is a side view of the laptop table assembly.

The smooth blind bore 27 in the top surface 26 of the mounting post 8 facilitates the attachment of various utility devices (not shown) such as a lamp, a secondary monitor, or a glass holder. As shown in FIGS. 6, 7, and 9, when a device is not attached to the mounting post 8, a top cap 32 may be attached to the mounting post 8 by press-fitting the cylindrical protrusion 33 on the top cap 32 into the smooth blind bore 27.

Figure 14A:
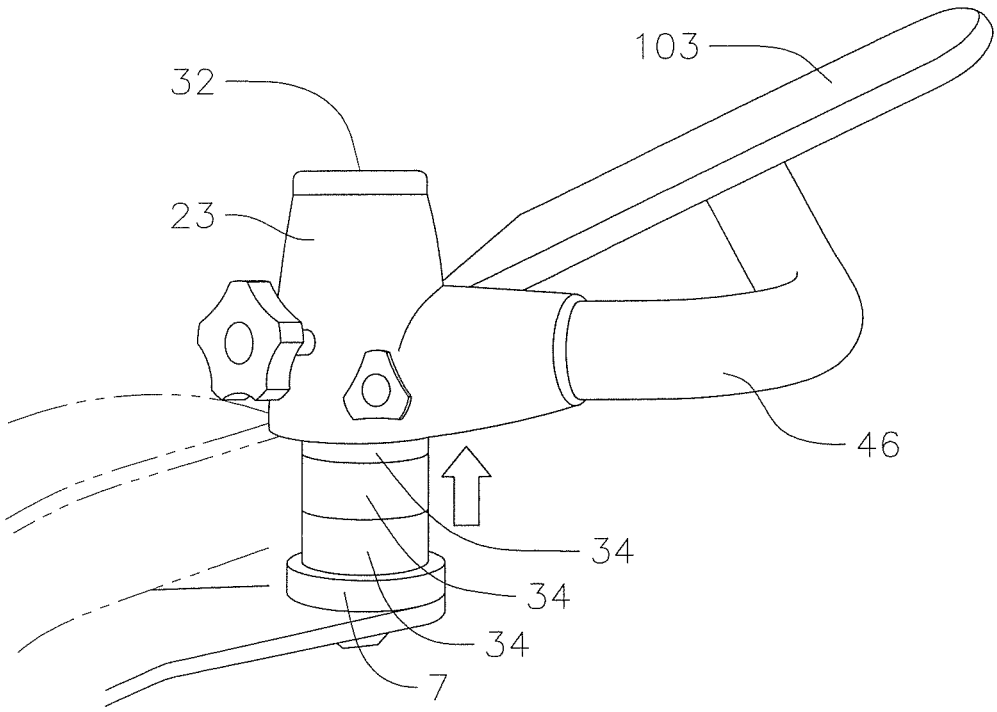
FIG. 14A is a side view of the laptop table assembly showing the spacer rings inserted between the elbow and the spacer plate in order to increase the overall height of the laptop table assembly.
Figure 14B:
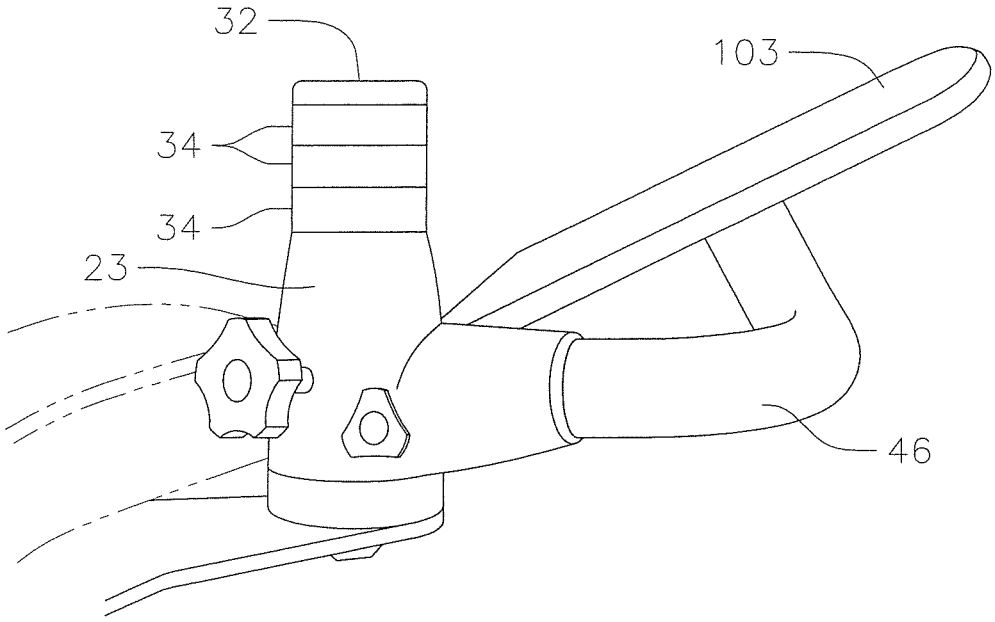
FIG. 14B is a side view of the laptop table assembly showing unused spacer rings stored on top of the elbow.
Figure 14C:
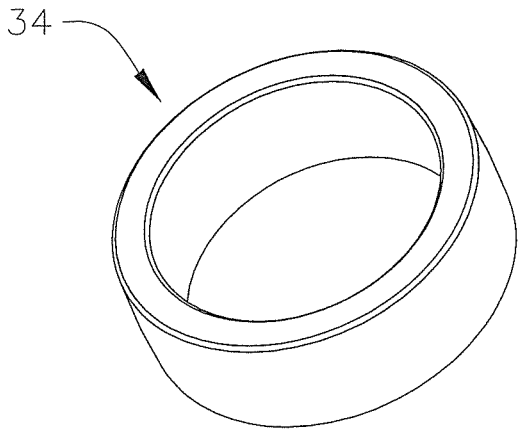
FIG. 14C is a perspective view of a spacer ring.

As depicted in FIGS. 14A and 14C, a plurality of spacer rings 34 are configured to slide onto the mounting post 8 and rest on top of the spacer plate 7. The spacer rings 34 adjust the overall height of the laptop table assembly 1 and thus increase the usable space between the recliner chair 125 and the laptop table assembly 1. Accordingly, a user selects the appropriate number of spacer rings 34 to accommodate the user's specific body type. In a preferred embodiment, three spacer rings 34 are provided and each spacer ring 34 is approximately 0.60 inches tall. In alternative embodiments, the number of spacer rings 34 and the height of each spacer ring 34 may vary to provide the user more or less refined control over the overall height of the laptop table assembly 1.

Figure 2A:
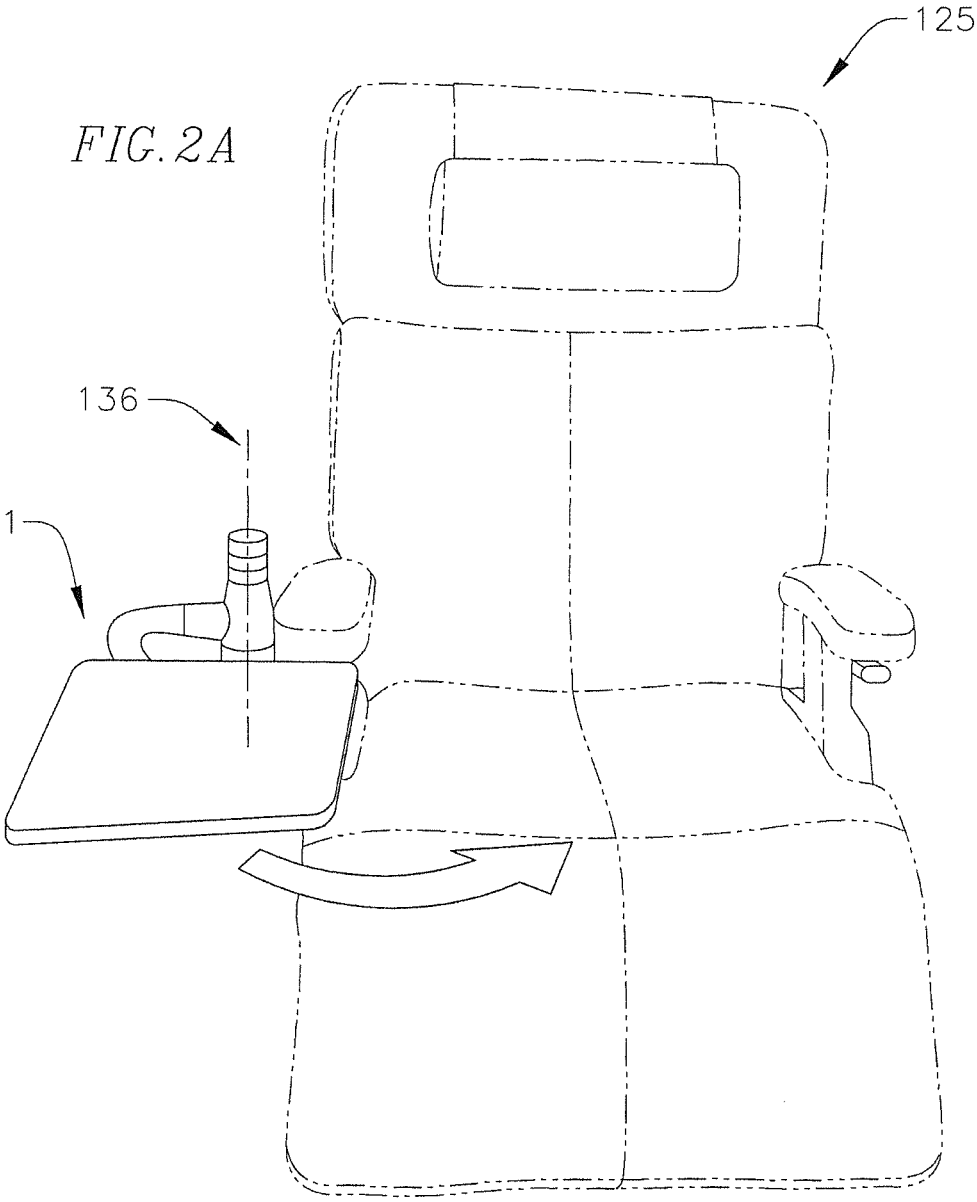
FIGS. 2A and 2B are a perspective view and a detail view, respectively, of the laptop table assembly mounted to a recliner chair showing the swinging capability of the laptop table assembly.
Figures 15A, 15B, 15C:
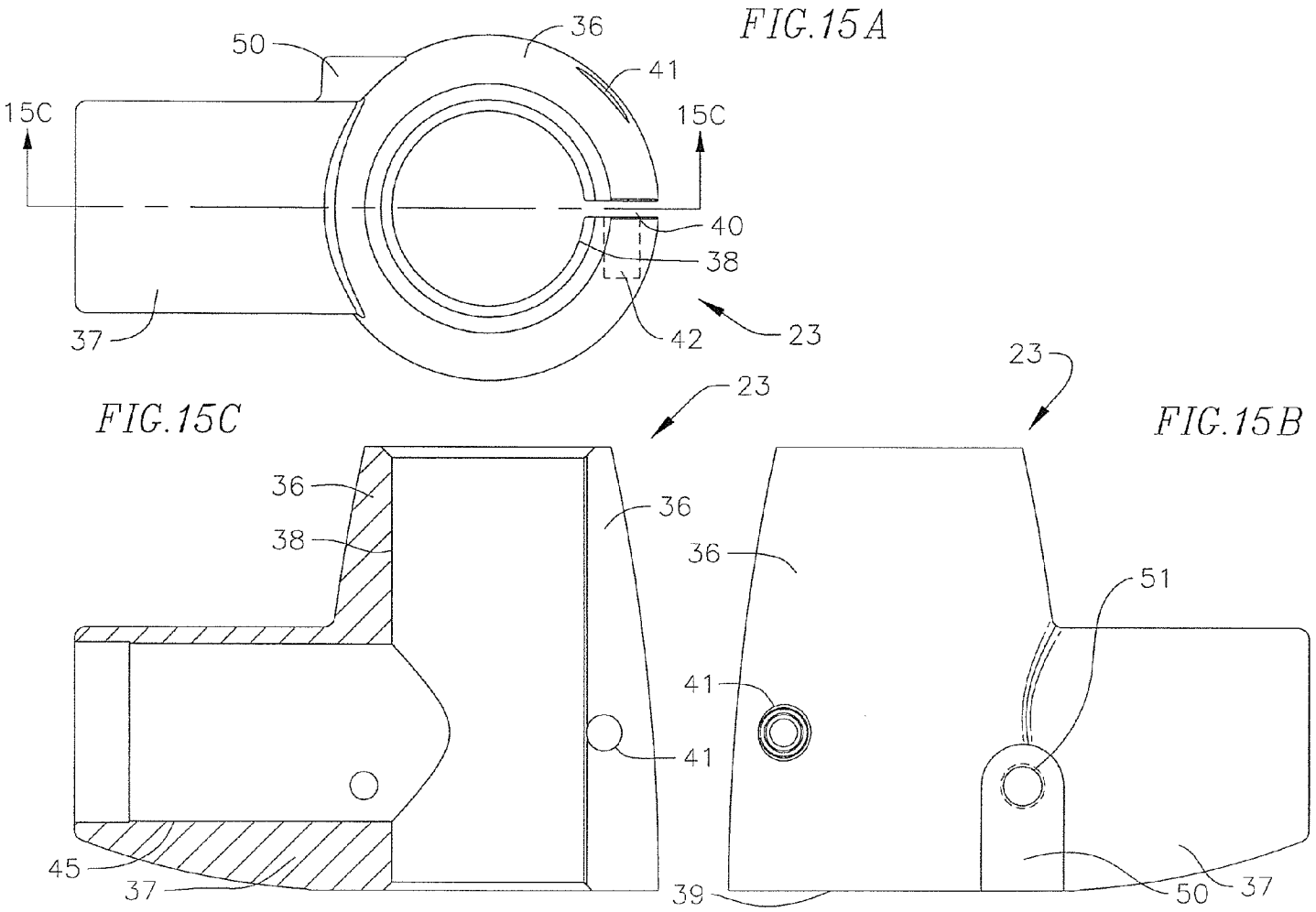
FIGS. 15A, 15B, and 15C are a top view, side view, and cross-sectional view of the elbow, respectively.

As shown in FIGS. 1, 5, 6, 7, 8, 9, the elbow 23 is provided to rotatably attach a swing arm assembly 35 to the mounting post 8 about a swing axis 136 (FIG. 2A). The elbow 23 comprises the vertical leg 36 and the horizontal leg 37. The vertical leg 36 is a frustum with a cylindrical opening 38 (FIG. 15A). The cylindrical opening 38 of the vertical leg 36 is configured to slide onto the outer surface of the mounting post 8 until a lower surface 39 of the vertical leg 36 rests on top of the spacer rings 34, if the user selected any, or on top of the spacer plate 7 if the user elected not to use any spacer rings 34. The vertical leg 36 permits the laptop table assembly 1 to rotate about the swing axis 136 extending through the centerline of the mounting post 8 and thereby swing out of the user's way for ingress and egress from the recliner chair or into the desired position for working with a laptop placed on the laptop table 103, as illustrated in FIG. 2A.

Figure 2B:
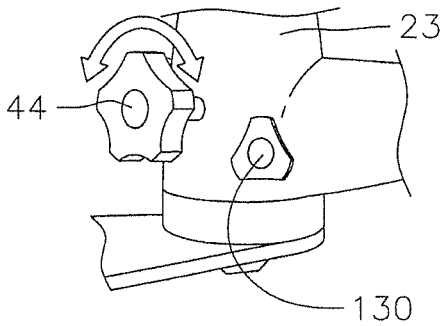
Figure 5:
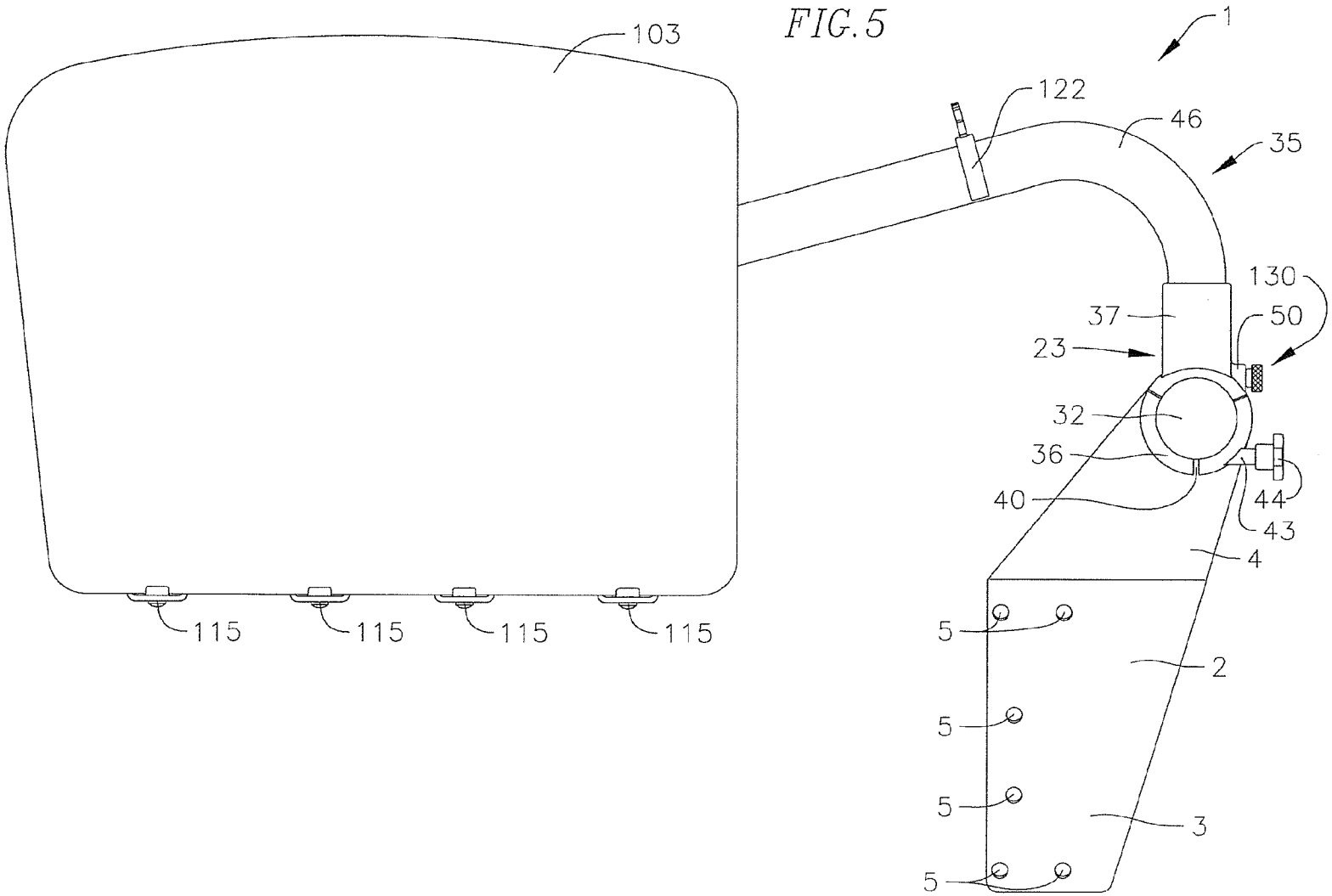
FIG. 5 is a top view of the laptop table assembly.

As illustrated in FIGS. 5, 6, and 15A, the vertical leg 36 of the elbow 23 also contains a narrow vertical slit 40 spanning the entire length of the vertical leg 36. The slit 40 permits the vertical leg 36 to circumferentially expand and contract around the mounting post 8, which decreases or increases the force necessary to swing the laptop table assembly 1 about the mounting post 8. The vertical leg 36 also contains a recessed opening 41 and an internally threaded bore hole 42, on opposite sides of the slit 40, which are configured to receive a threaded shaft 43 of a knob set screw 44. When the threaded shaft 43 of the knob set screw 44 is fully inserted into the recessed opening 41, the threaded shaft 43 orthogonally spans the slit 40 and engages the internally threaded bore hole 42. Adjusting the knob set screw 44 in the clockwise direction decreases the width of the slit 40 and thereby causes the vertical leg 36 to circumferentially contract around the mounting post 8. In contrast, adjusting the knob set screw 44 in the counterclockwise direction increases the width of the slit 40 and thereby causes the vertical leg 36 to circumferentially expand around the mounting post 8. Accordingly, as illustrated in FIG. 2B, the user adjusts the knob set screw 44 in either the clockwise or counterclockwise direction until the user achieves a desired amount of force necessary to swing the laptop table assembly 1 about the swing axis 136. In an alternative embodiment, the vertical leg 36 of the elbow 23 may contain one or more vertical notches (not shown) radially disposed on an outer surface of the vertical leg 36, which are configured to reduce the force necessary to contract the vertical leg 36 about the mounting post 8.

As illustrated in FIG. 14B, any unused spacer rings 34 may be stored on top of the vertical leg 36 of the elbow 23 by sliding the unused spacer rings 34 onto the mounting post 8 after the elbow 23 has been installed. The top cap 32 secured to the smooth blind bore 27 of the mounting post 8 ensures that the unused spacer rings 34 do not inadvertently disengage the mounting post 8.

Referring now to FIGS. 5, 7, 8, and 15C, the horizontal leg 37 of the elbow 23 comprises a cylindrical opening 45 configured to receive the proximal end of the swing arm assembly 35. As shown in FIGS. 16A and 16B, the swing arm assembly 35 comprises the tubular swing arm 46 and an attachment member 47. The swing arm 46 is an angular tube formed from any suitable material, such as aluminum, steel, or carbon fiber-reinforced polymer. In an exemplary embodiment, the swing arm 46 has a seventy-five degree bend. The distal end of attachment member 47 has a circumferential recess 48 that is press fit into the proximal end of the tubular swing arm 46 and is secured by any suitable means, such as welding.

Figure 3A:
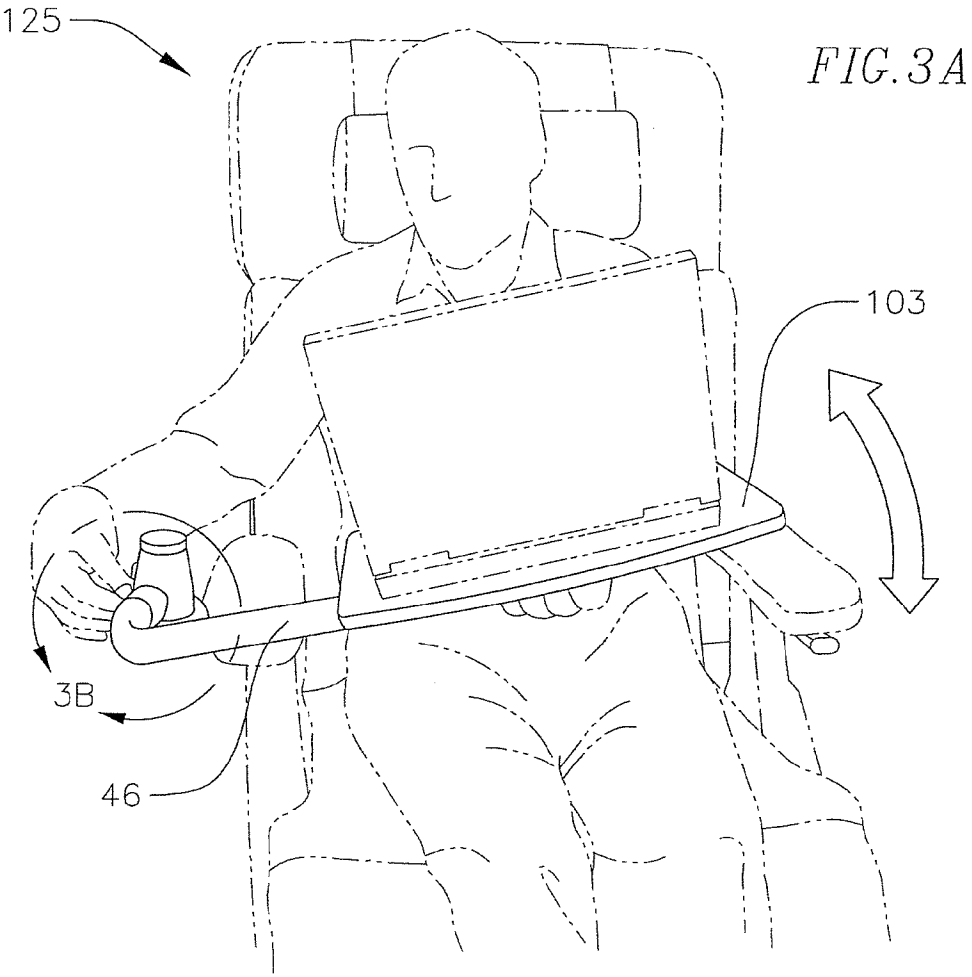
FIGS. 3A and 3B are a perspective view and a detail view, respectively, of the laptop table assembly mounted to a recliner chair showing the leveling capability of the laptop table assembly.
Figure 3B:
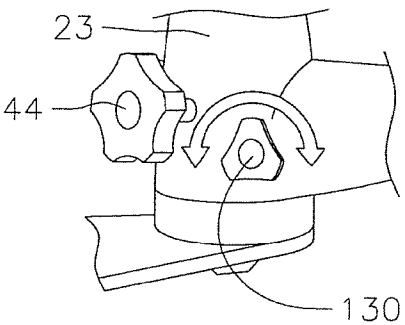

The proximal end of the attachment member 47, which extends into the cylindrical opening 45 in the horizontal leg 37 of the elbow 23, contains an outer circumferential notch 49 which permits the user to adjust the level of the laptop table assembly 1, as depicted in FIG. 3A. The level of the laptop table assembly 1 is adjustable to permit a user to compensate for the weight of an object, such as a laptop, placed on the laptop table 103 which tends to deflect the laptop table assembly 1 downward. Once the appropriate leveling angle is achieved, the user tightens a leveling set screw 130 to set the level of the swing arm assembly 35, as illustrated in FIG. 3B. Adjusting the leveling set screw 130 in the clockwise direction causes a threaded shaft (not shown) of the leveling set screw 130 to engage the outer circumferential notch 49 and thereby set the level of the laptop table assembly 1.

As a safety feature, however, even when the leveling set screw 130 is engaged with the outer circumferential notch 49, the laptop table assembly 1 is adapted to tilt past the set position in order to prevent pinning the user's legs between the recliner chair 125 and the laptop table assembly 1 if the recliner chair 125 is inadvertently reclined and the user's legs are forced upwards into the laptop table assembly 1. In fact, when the threaded shaft of the leveling set screw 130 is extended into the outer circumferential notch 49, the laptop table assembly 1 is configured to tilt to an angle corresponding to a span 131 of the outer circumferential notch 49. In an exemplary embodiment, the outer circumferential notch 49 spans approximately thirty degrees, which permits the laptop table assembly 1 to rotate approximately thirty degrees about the longitudinal axis of the horizontal leg 37 of the elbow 23. In an alternative embodiment, the outer circumferential notch 49 may span substantially more than thirty degrees, such as two hundred seventy degrees, in order to permit the laptop table assembly 1 to rotate into a stored configuration (not shown).

Additionally, as depicted in FIGS. 5, 7, 8, 15A, and 15B, the horizontal leg 37 of the elbow 23 contains a boss 50 with an axial bore 51 configured to receive the threaded shaft of the swivel set screw 130. In an alternative embodiment, a spacer (not shown) may be provided instead of incorporating a boss 50 into the horizontal leg 37 of the elbow 23.

Figure 8:
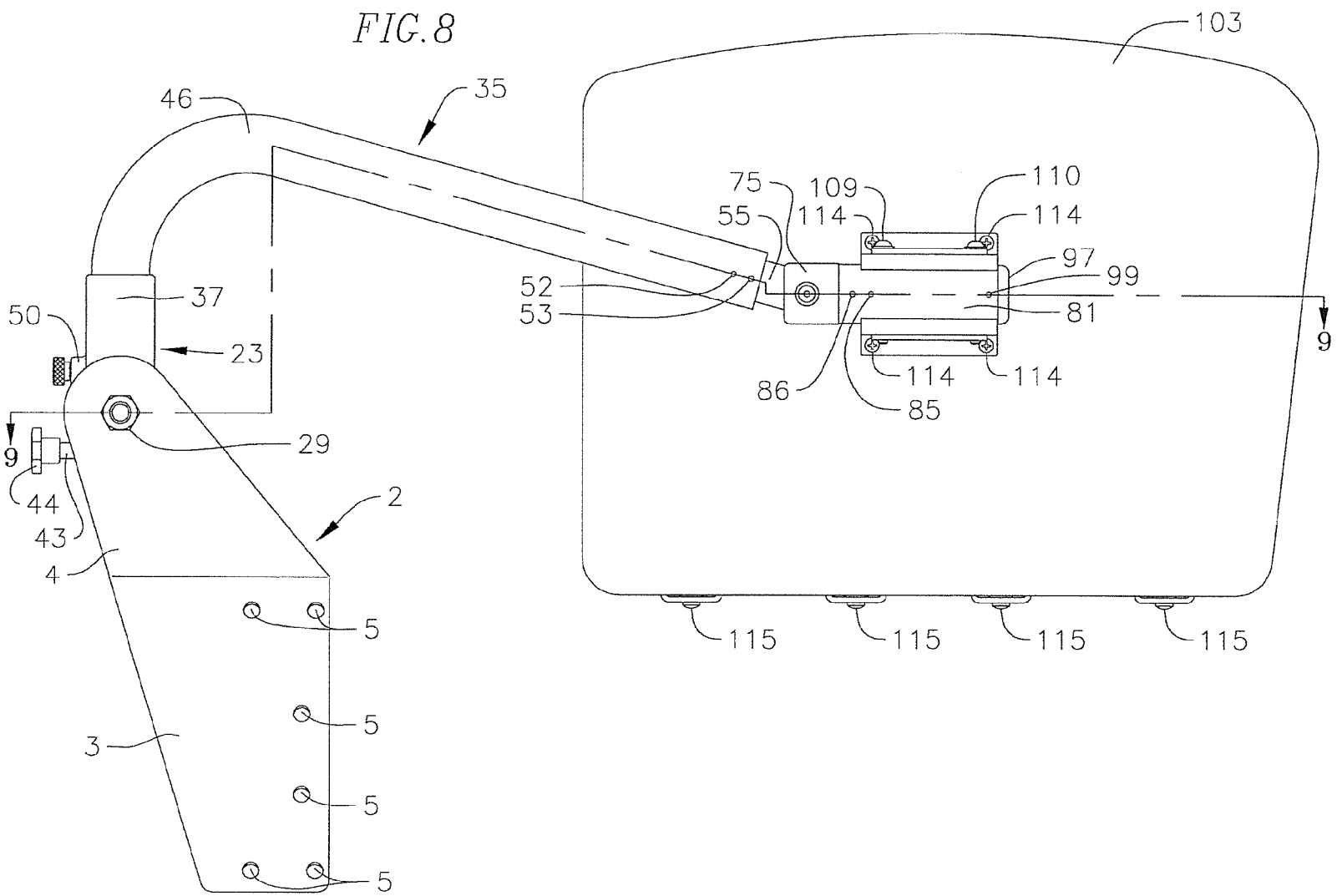
FIG. 8 is a bottom view of the laptop table assembly.
Figure 18:
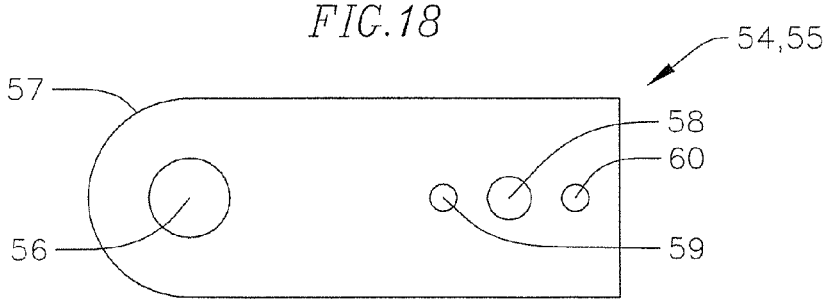
FIG. 18 is a top view of the upper and lower hinge blades.

As shown in FIGS. 6, 8, and 9, two hinge blades 54, 55 are configured to connect the distal end of the swing arm 46 to the proximal end of the hinge 75 which permits the user to swivel (FIG. 4) the laptop table assembly 1 about a swivel axis 135 (FIG. 9). As shown in FIG. 18, the hinge blades 54, 55 are flat plates with a pivot hole 56 and a rounded edge 57 on the distal end. The proximal end of the hinge blades 54, 55 contain a mounting hole 58 and two pin holes 59, 60 on either side of the mounting hole 58.

Figure 17A:
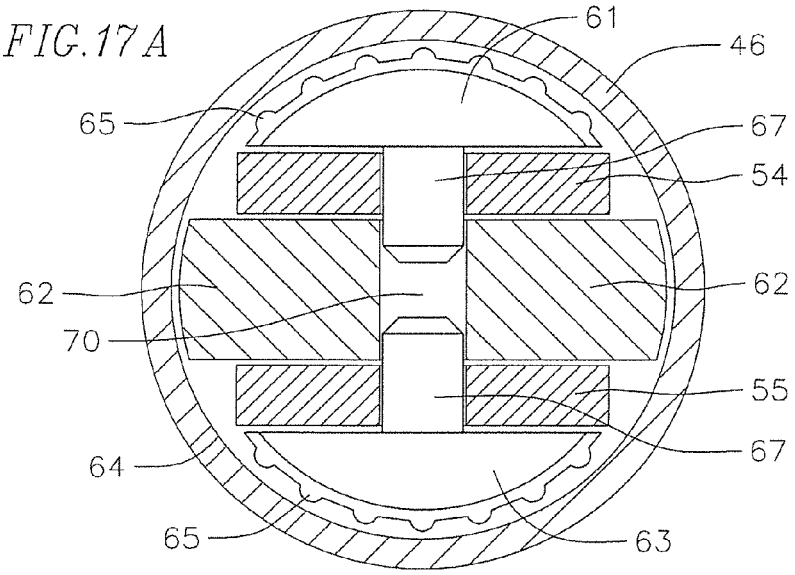
FIG. 17A is a cross-sectional view showing the hinge blades connected to the distal end of the swing arm by an upper hinge blade holder, a central hinge blade holder, and a lower hinge blade holder.
Figure 17B:
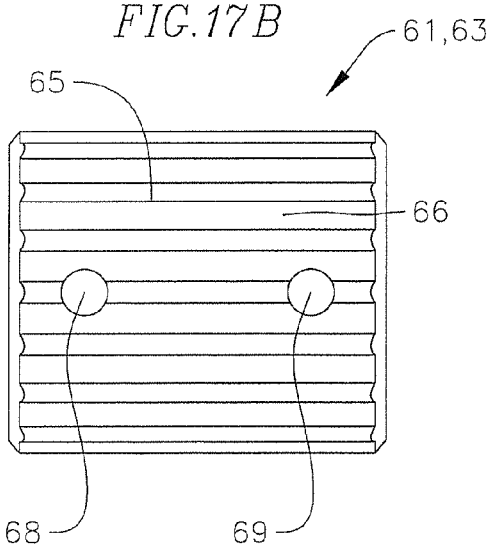
FIG. 17B is a top view of the upper and lower hinge blade holders.

Referring now to FIG. 17A, the proximal ends of the hinge blades 54, 55 are secured to the distal end of the swing arm 46 by an upper hinge blade holder 61, a central hinge blade holder 62, and a lower hinge blade holder 63. The upper and lower hinge blade holders 61, 63 are located between the outer wall 51 of the swing arm 46 and the upper and lower hinge blades 54, 55, respectfully. The upper and lower hinge blade holders 61, 63 are configured to engage an arcuate segment of an interior portion 64 of the distal end of the swing arm 46. The upper and lower hinge blade holders 61, 63 contain a series of longitudinal ridges 65 disposed on an outer surface 66 of the upper and lower hinge blade holders 61, 63 to facilitate engagement with the swing 46. The upper and lower hinge blade holders 61, 63 also contain a cylindrical post 67 configured to engage the mounting holes 58 in the proximal end of the hinge blades 54, 55 and thereby ensure the upper hinge blade 54 is aligned above the lower hinge blade 55. Additionally, as shown in FIGS. 8, 9, 17B, and 18, the upper and lower hinge blade holders 61, 63 contain two through holes 68, 69 configured to align with two through holes 52, 53 located in the outer wall 51 of the distal end of the swing arm 46 and the two pin holes 59, 60 located in the proximal end of the hinge blades 54, 55.

Figure 17C:
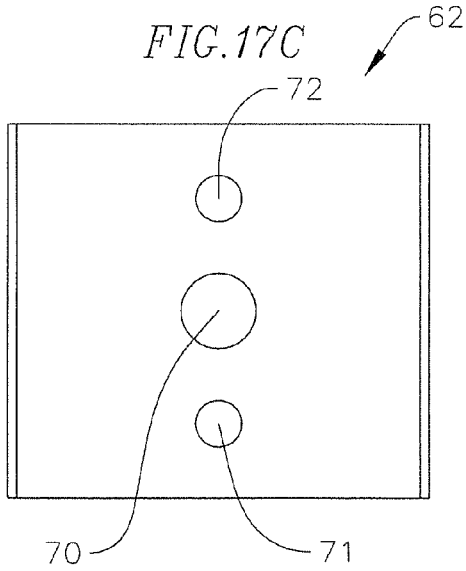
FIG. 17C is a top view of the central hinge blade holder.

With continued reference to FIG. 17A, the central hinge blade holder 62 is located between the upper and lower hinge blades 54, 55. Exterior portions of the central hinge blade holder 62 are configured to engage arcuate segments of the interior portion 64 of the distal end of the swing arm 46. The central hinge blade holder 62 has a central bore 70 configured to accept the cylindrical posts 67 on the upper and lower hinge blade holders 61, 63. Additionally, as shown in FIG. 17C, the central hinge blade holder 62 contains two through holes 71, 72 configured to align with the two through holes 68, 69 in the upper and lower hinge blade holders 61, 63, the two through holes 52, 53 located in the outer wall 51 of the distal end of the swing arm 46, and the two pin holes 59, 60 located on the proximal ends of the hinge blades 54, 55. Accordingly, the proximal ends of the hinge blades 54, 55 are attached to the distal end of the swing arm 46 by two pins 73, 74 extending through holes 52, 53 in the swing arm 46, holes 68, 69 in the upper hinge blade holder 61, holes 59, 60 in the upper hinge blade 54, holes 71, 72 in the central hinge blade holder 62, holes 59, 60 in the lower hinge blade 55, and holes 68, 69 in the lower hinge blade holder 63. The thickness of the central hinge blade holder 62 is substantially the same as the distance between two channels 76, 77 in the hinge 75 in order to ensure that the distance between the upper and lower hinge blades 54, 55 remains substantially constant between the distal ends and the proximal ends of the upper and lower hinge blades 54, 55.

Figure 19B:
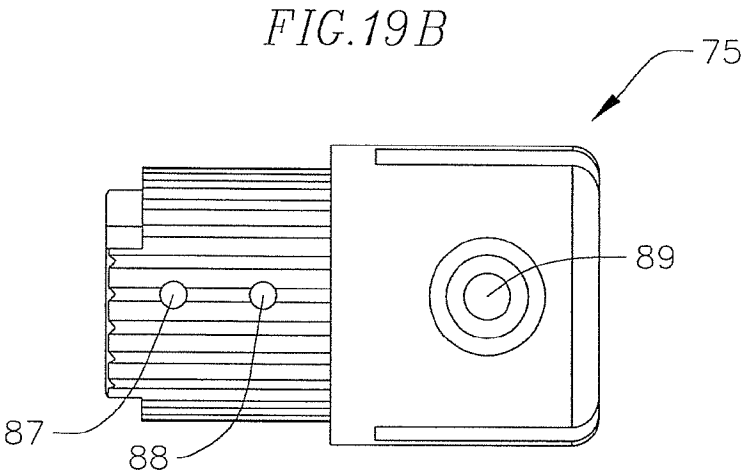
FIGS. 19A, 19B, and 19C are a perspective view, top view, and a side view of the hinge, respectively.
Figure 19C:
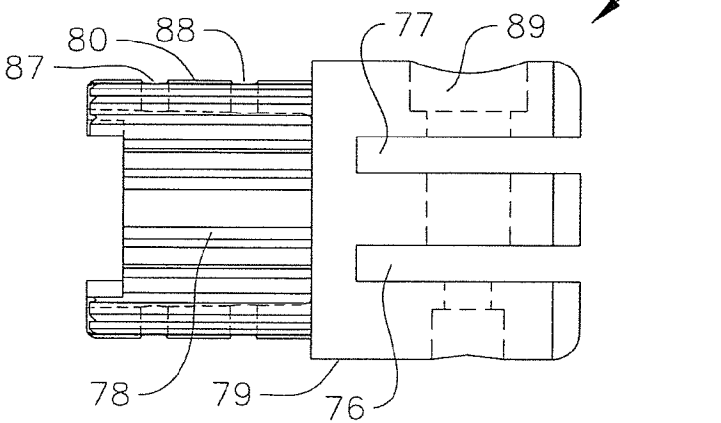
Figure 19A:
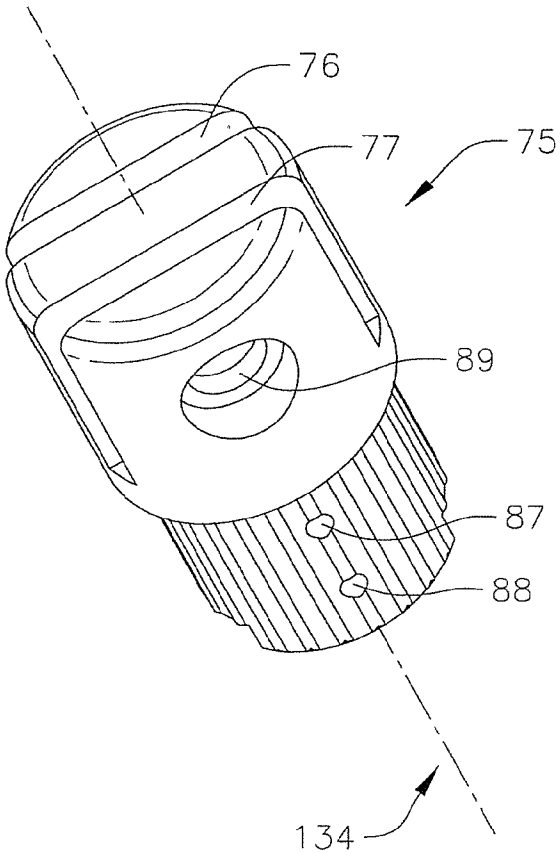

As depicted in FIGS. 19A, 19B, and 19C, the hinge 75 comprises a cylindrical rod 78 having an outer diameter 79 that is larger at its proximal end. The distal end of the hinge 75 has an outer diameter 80 substantially equal to an inner diameter 82 of a deck arm 81 in order to facilitate a press fit connection between the distal end of the hinge 75 and the deck arm 81, shown in FIGS. 20A, 20B, and 20C. Moreover, the distal end of the hinge 75 is secured to the deck arm 81 with two pins 83, 84 extending through holes 85, 86 in the proximal end of the deck arm 81 and holes 87, 88 in the distal end of the hinge 75. The proximal end of the hinge 75 contains the two channels 76, 77 configured to receive the distal ends of the hinge blades 54, 55. A through hole 89 in the hinge 75 aligns with the pivot holes 56 in the hinge blades 54, 55. The hinge 75 is rotatably secured to the hinge blades 54, 55 with a bushing 90 and a fastener 91. The rounded edges 57 on the hinge blades 54, 55 permit the hinge 75 to swivel about the swivel axis 135 (FIG. 4), which extends through the pivot holes 56 in the hinge blades 54, 55 and the through hole 89 in the hinge. Adjustment of the fastener 91 increases or decreases the amount of force required to swivel the laptop table assembly 1 about the swivel axis 135.

Figure 4:
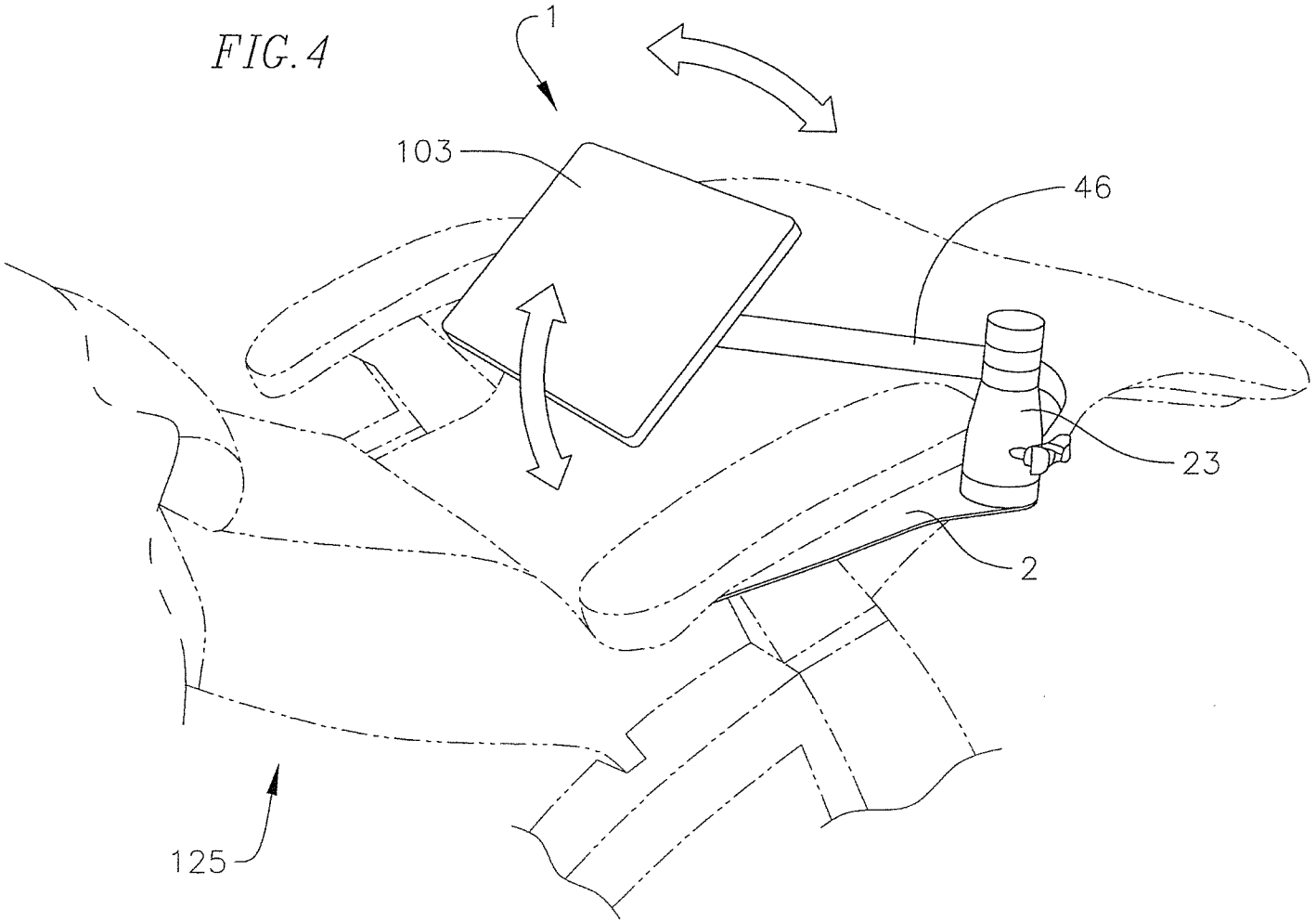
FIG. 4 is a perspective view of the laptop table assembly mounted to a recliner chair showing the pitch adjustability of the laptop table assembly.
Figure 20C:
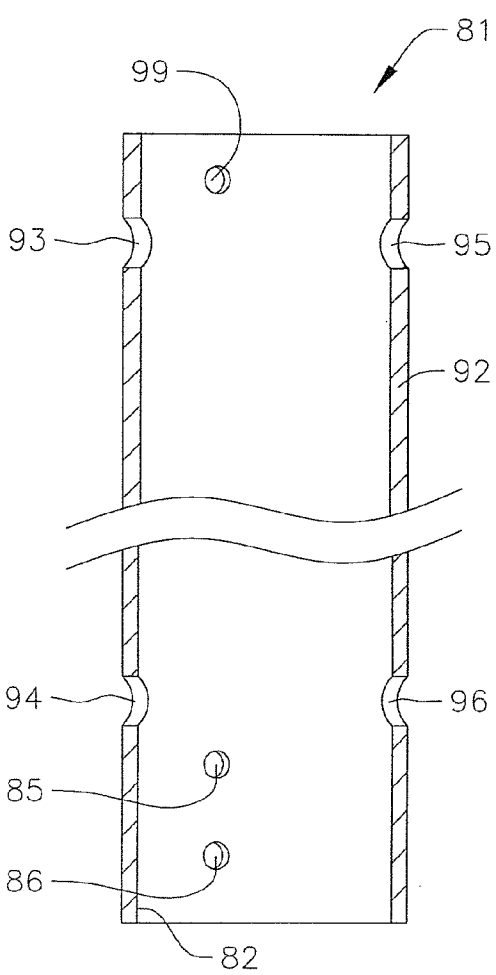
FIGS. 20A, 20B, and 20C are a top view, front view, and a cross-sectional view of the deck arm, respectively.
Figure 20B:
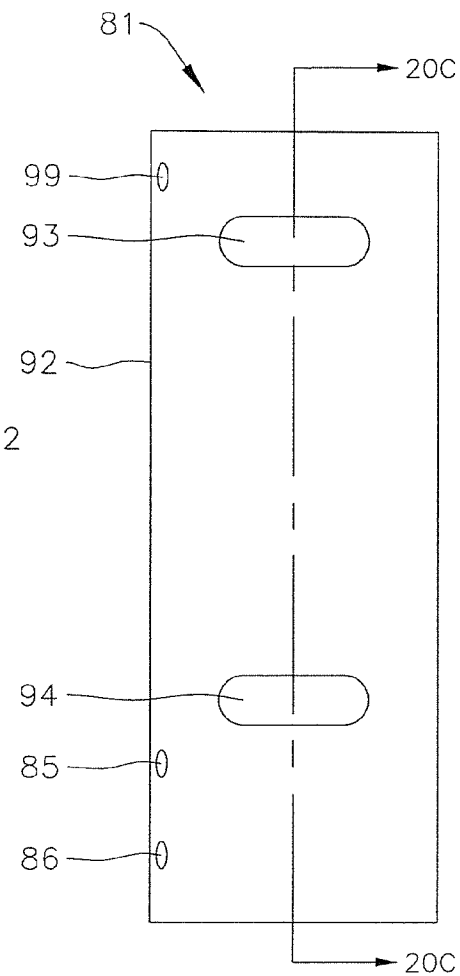
Figure 20A:
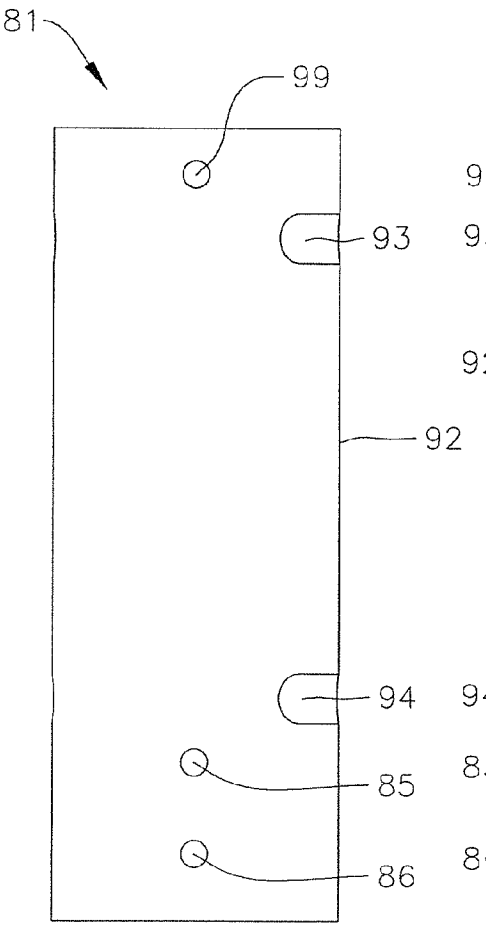
Figure 21A:
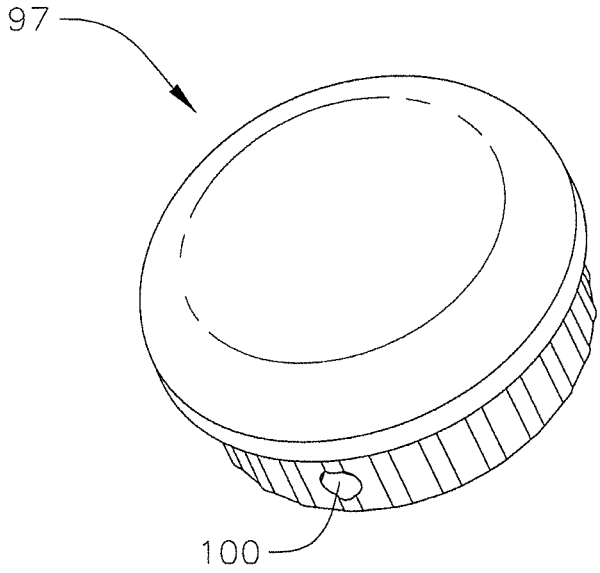
FIGS. 21A and 21B are a perspective view and a top view of the button head arm cap, respectively.
Figure 21B:
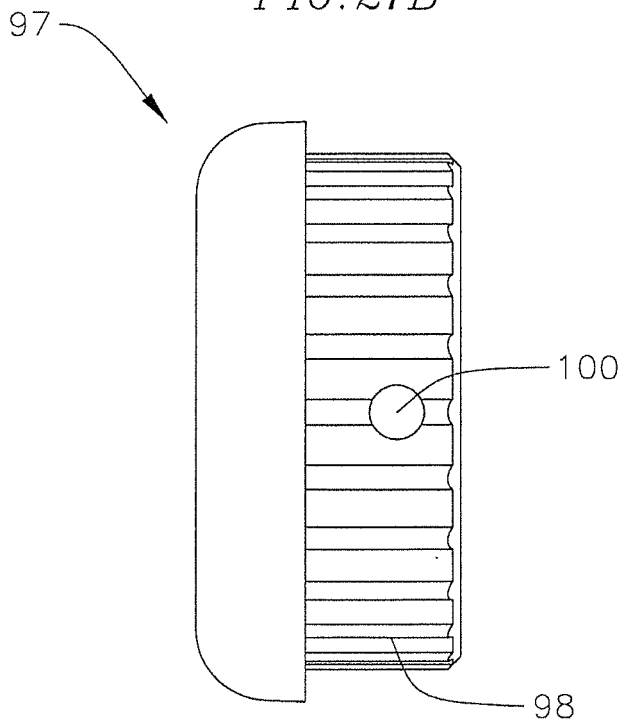

As illustrated in FIGS. 20A, 20B, and 20C, the deck arm 81 comprises a cylindrical tube 92 with the two through holes 85, 86 in its proximal end for securing the hinge 75 to the deck arm 81. The deck arm 81 also contains four ovaloid openings 93, 94, 95, 96 which permit the user to control the pitch of the laptop table 103 by rotating the laptop table 103 about a pitch axis 134, which extends through the centerline of the deck arm 81, as depicted in FIGS. 4 and 9. Two of the ovaloid openings 93, 94 are located on the forward portion of the deck arm 81 and the two other ovaloid openings 95, 96 are located on the rear portion of the deck arm 81 and are aligned with the two ovaloid openings 93, 94 on the forward portion of the deck arm 81.

Furthermore, as shown in FIGS. 6, 8, 21A, and 21B, a button head arm cap 97 is provided to seal off the distal end of the deck arm 81. The button head arm cap 97 contains a cylindrical protrusion 98 on the proximal end of the button head arm cap 97 that is configured for a press fit connection with the inner portion 82 of the deck arm 81. Additionally, the button head arm cap 97 is secured to the deck arm 81 by a fastener 132 that extends through a hole 99 in the distal end of the deck arm 81 that is configured to align with a hole 100 in cylindrical protrusion 98 formed on the button head arm cap 97. In one exemplary embodiment, the button head arm cap 97 is formed from any suitable polymer. In an alternative embodiment, the distal end of the deck arm 81 may be sealed off by a circular plate (not shown) welded to the cylindrical tube 92.

Figure 22A:
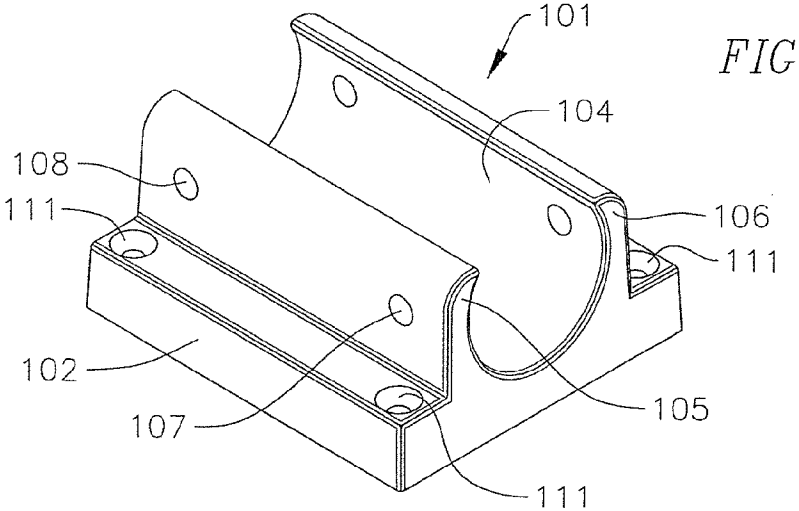
FIGS. 22A, 22B, and 22C are a perspective view, back view, and a side view of the deck tilt mount, respectively.
Figure 22C:
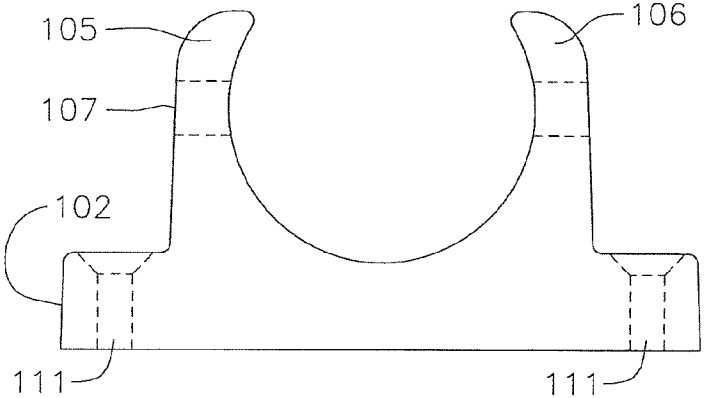
Figure 22B:
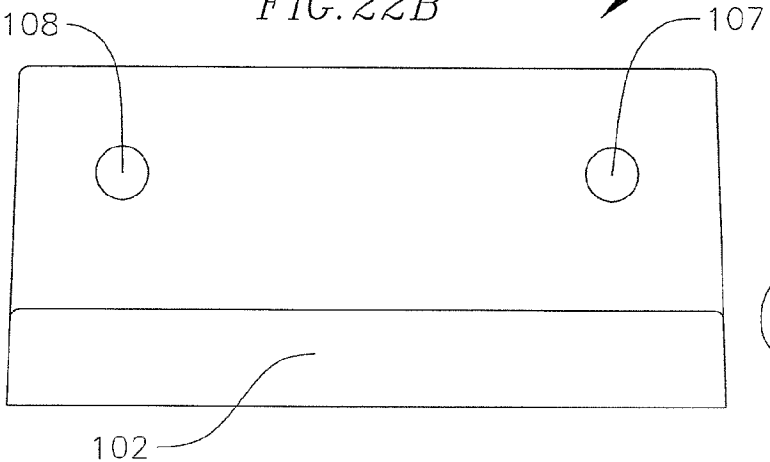

Referring now to FIGS. 22A, 22B, and 22C, a deck tilt mount 101 has a base member 102 for attaching the laptop table 103 to the deck tilt mount 101 and an open arcuate channel 104 configured to receive the deck arm 81. The open arcuate channel 104 is formed by two gripping arms 105, 106 extending downward from the base member 102. The two gripping arms 105, 106 contain two through holes 107, 108 configured to align with the ovaloid openings 93, 94, 95, 96 in the deck arm 81. Two fasteners 109, 110 extend through the through holes 107, 108 in the gripping arms 105, 106 and the ovaloid openings 93, 94, 95, 96 in the deck arm 81 to rotatably secure the deck arm 81 to the deck tilt mount 101. Adjusting the fasteners 109, 110 causes the gripping alms 105, 106 to expand or contract around the deck arm 81, thereby decreasing or increasing the force necessary to pitch the laptop table 103 about the pitch axis 134 extending through the centerline of the deck arm 81. The user pitches the laptop table 103 to achieve the appropriate working angle when the chair is in either a reclined or unreclined position. The four ovaloid openings 93, 94, 95, 96 permit the laptop table 103 to pitch to an extent corresponding to the circumferential span of the ovaloid openings 93, 94, 95, and 96. In an exemplary embodiment, the ovaloid openings 93, 94, 95, and 96 span approximately fifty degrees, which permits the laptop table 103 to pitch approximately fifty degrees. In an alternative embodiment, the ovaloid openings 93, 94, 95, and 96 may span a different distance, for example, ranging between about twenty degrees and one-hundred twenty degrees, in order to permit more or less control of the angular position of the laptop table 103 by the user.

Figure 23A:
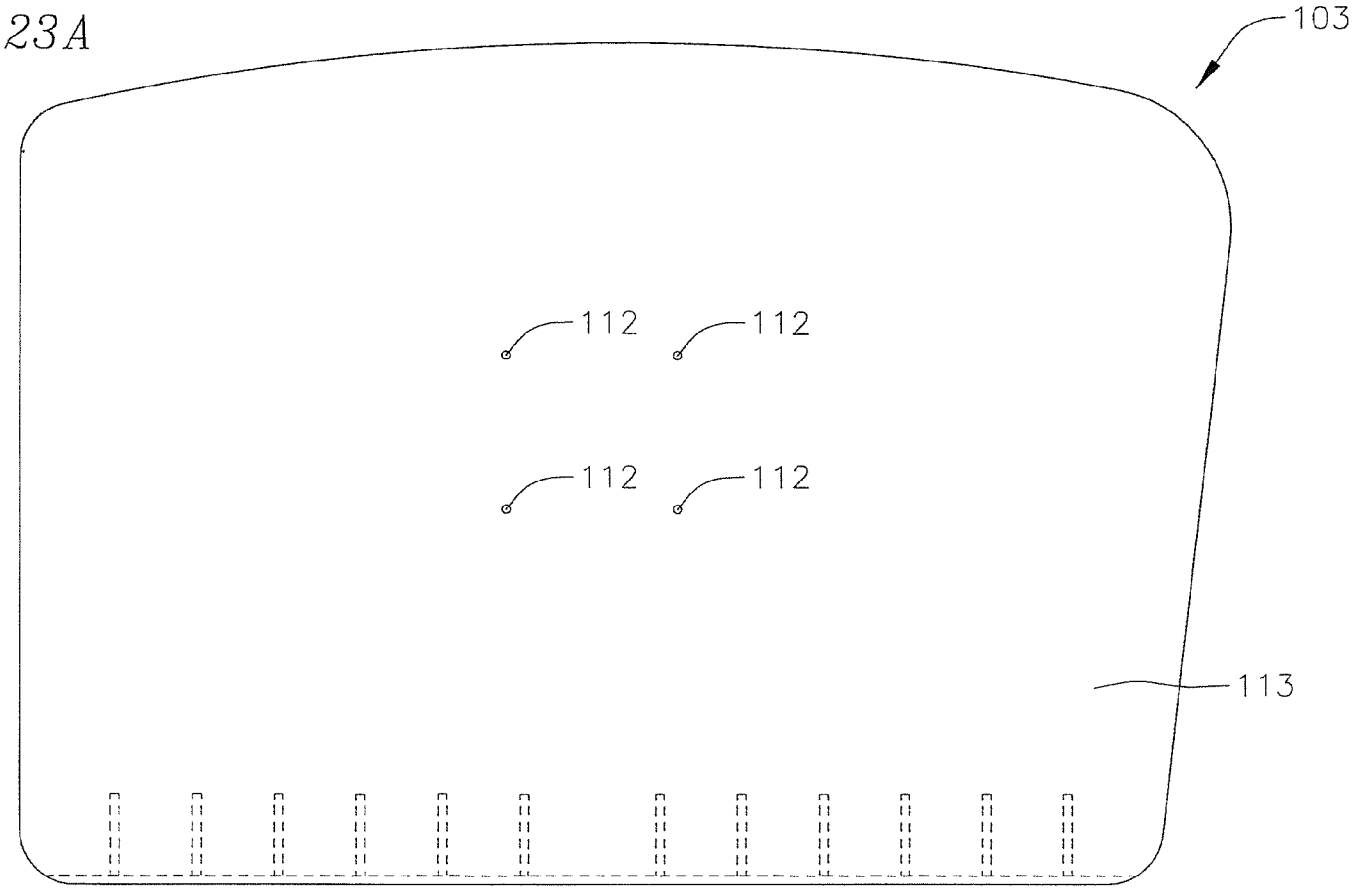
FIGS. 23A and 23B are a bottom view and a back view of the laptop table, respectively.
Figure 23B:
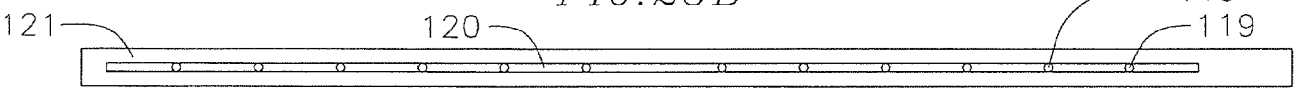
Figures 24A, 24B, 24C:
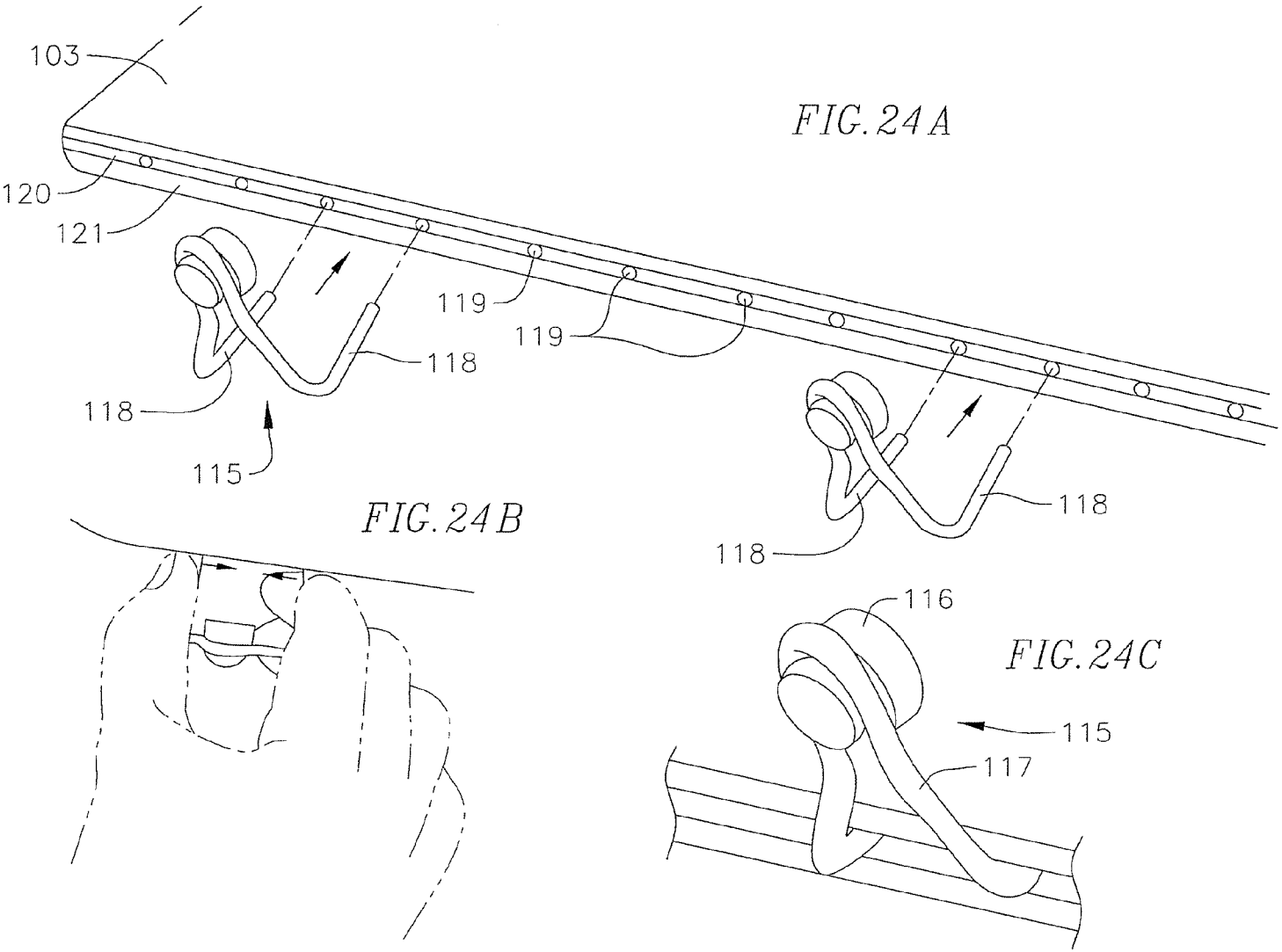
FIG. 24A is a perspective view showing the installation of the edge stop assemblies.
FIG. 24B is a perspective view showing a user installing an edge stop assembly by compressing two prongs and inserting the prongs into two holes in the laptop table.
FIG. 24C is a perspective view showing an edge stop assembly installed in the laptop table.

The base member 102 of the deck tilt mount 101 contains four countersunk holes 111 aligned with four blind holes 112 located in the lower surface 113 of the laptop table 103 (FIG. 23A). The deck tilt mount 101 is secured to the laptop table 103 with four countersunk screws 114 extending through the four countersunk holes 111 in the base member 102 and into the four blind holes 112 in the laptop table 103.

As illustrated in FIGS. 5, 6, 7, 8, 24A, 24B, and 24C, a pair of edge stop assemblies 115 are provided to prevent the user's laptop from sliding off the laptop table 103 when the laptop table 103 is pitched toward the user. Each edge stop assembly 115 comprises a rubber bumper 116 secured to a flexible clip member 117. The flexible clip member 117 contains two prongs 118 configured to be inserted into a series of blind holes 119 disposed within a channel 120 formed on the rearward-facing surface 121 of the laptop table 103. The user installs the two edge stop assemblies 115 by elastically compressing the prongs 118 and inserting the prongs 118 into the appropriate pair of blind holes 119 selected by the user. The user selects the appropriate positioning of the edge stop assemblies 115 so as not to obstruct portions of the laptop requiring user access, such as an optical drive and USB ports. After the user installs the edge stop assemblies 115, the user places a laptop on the laptop table 103 and abuts at lease a portion of the laptop to the edge stop assemblies 115 in order to secure the positioning of the laptop. It is contemplated that edge stop assemblies 115 with various heights may be provided to accommodate laptops with different thicknesses and configurations.

As shown in FIGS. 5 and 7, a series of cable management clips 122 attached to the swing arm 46 are provided to safely and conveniently position computer cables away from the laptop table 103. The cable management clips 122 contain an open annulus 123 for detachably attaching the cable management clips 122 to the outer wall 51 of the swing arm 46 and a small open ring 124 configured to accept the computer cables. In a preferred embodiment, two cable management clips 122 are provided. In an alternative embodiment, straps (not shown), such as fabric hook and loop fasteners or ratcheting cable ties, may be provided instead of, or in addition to, the cable management clips 122 in order to safely and conveniently secure the computer cables. It is contemplated that the number of straps or cable management clips 122 provided may vary to suit the individual needs of the user.

Figure 25:
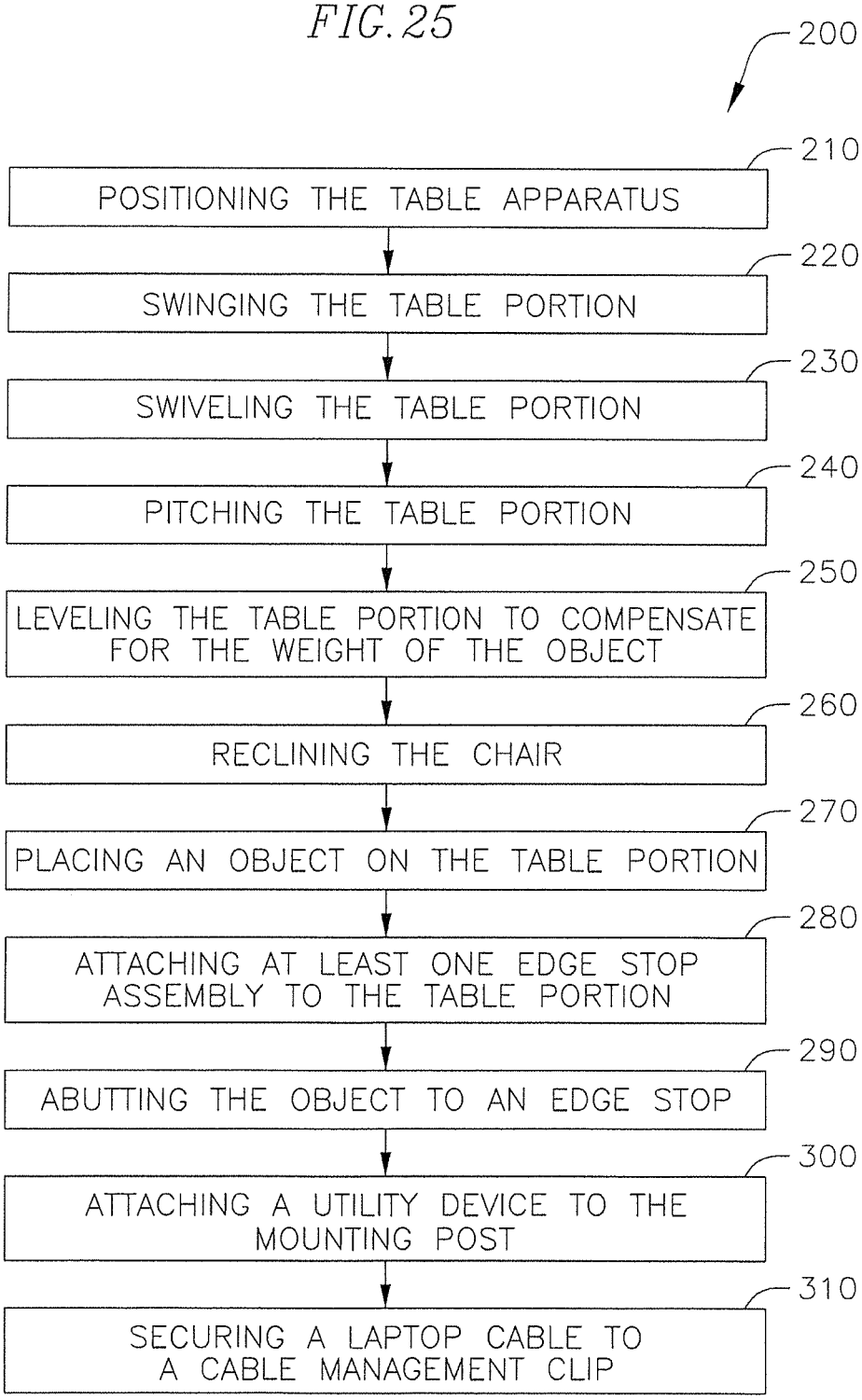
FIG. 25 is a flowchart showing tasks of a method of using a laptop table according to an embodiment of the present invention.

With reference to FIG. 25, a method 200 of using a laptop table assembly 1 is shown. In one embodiment, the method 200 includes a task 210 of positioning the laptop table assembly 1. In another embodiment, the method 200 includes a task 220 of swinging the laptop table 103 to permit, for example, the user to enter into or exit from the chair 125 or to permit the user to achieve a desired position of the laptop table 103. In a further embodiment, the method 200 includes a task 230 of swiveling the laptop table 103. Moreover, in another embodiment, the method 200 includes a task 240 of pitching the laptop table 103 to achieve, for example, a desired viewing angle of a laptop screen placed on the laptop table 103. The method 200 includes, in one embodiment, a task 250 of leveling the laptop table 103 to compensate for the weight of a laptop or any other item placed on the laptop table 103. In another embodiment, the method 200 includes a task 260 of reclining the chair 125. Further, in one embodiment, the method 200 includes one or more of the following tasks, which include a task 270 of placing a laptop on the laptop table 103, a task 280 of attaching at least one edge stop assembly 115 to the laptop table 103, and a task 290 of abutting a laptop to at least one edge stop assembly 115. In a further embodiment, the method 200 includes a task 300 of attaching a utility device, such as a secondary monitor, a lamp, or a glass holder to the mounting post 8. In another embodiment, the method 200 includes a task 310 of securing a laptop cable to at least one cable management clip 122.

While in one embodiment, the method 200 of using a laptop table assembly 1 may include each of the tasks described above and shown in FIG. 25, in other embodiments of the present invention, in a method of using a laptop table assembly 1, one or more of the tasks described above and shown in FIG. 25 may be absent and/or additional tasks may be performed. For example, the task 240 of pitching the laptop table 103 may be performed without also performing the task 260 of reclining the chair 125. Further, in the method 200 of using the laptop table assembly 1 according to one embodiment, the tasks may be performed in the order depicted in FIG. 25. However, the present invention is not limited thereto and, in a method of using a laptop table assembly 1 according to other embodiments of the present invention, the tasks described above and shown in FIG. 25 may be performed in any other suitable sequence. For example, in one embodiment, the task 260 of reclining the chair 125 is performed before the task 240 of pitching the laptop table 103, while in an alternative embodiment, the task 240 of pitching the laptop table 103 is performed before the task 260 of reclining the chair 125.

Although the drawings illustrate the invention as applied to a laptop table for a reclinable chair, it will be apparent that the novel aspects of the laptop table of the present invention may also be applied to other applications, such as for other chairs. Also, while the above description and accompanying drawings describe the table of the present invention as being useable for supporting a laptop, it will be apparent that the novel aspects of the table of the present invention may also be used to support other items, such as books or writing pads. Further, it will be apparent to those skilled in the art that a laptop table may incorporate or embody various combinations of the embodiments described above with respect to the shapes, sizes, and components of the laptop table, as well as alternatives not described herein, without departing from the spirit and scope of the present invention.

The preceding description has been presented with reference to some exemplary embodiments of the invention. Persons skilled in the art and technology to which this invention pertains will appreciate that alterations and changes in the described structures and methods of assembly and operation can be practiced without meaningfully departing from the principles, spirit, and scope of this invention, as set forth in the following claims.

What is claimed is:

1. A table apparatus, comprising:

a mounting bracket defining a swing axis, the mounting bracket configured to attach to a chair;

a mounting post configured to connect to the mounting bracket about the swing axis;

an elbow having a vertical leg and a horizontal leg, the vertical leg configured to rotatably connect to the mounting post about the swing axis;

a swing arm including a proximal end and a distal end opposite the proximal end, the proximal end configured to rotatably connect to the horizontal leg of the elbow, and the distal end defining a swivel axis;

a hinge including a first end and a second end, the first end configured to rotatably connect to the distal end of the swing arm about the swivel axis, and the second end defining a pitch axis substantially orthogonal to the swivel axis; and a table portion configured to rotatably connect to the second end of the hinge about the pitch axis.

2. The table apparatus of claim 1, further comprising:

an outer circumferential notch in the proximal end of the swing arm configured to rotatably connect to the horizontal leg;

at least one spacer ring configured to slide onto the mounting post; and a deck tilt mount having an upper portion and a lower portion, the upper portion configured to connect to the table portion and the lower portion configured to rotatably connect to the hinge about the pitch axis.

3. The table apparatus of claim 1, further comprising a polymer sleeve configured to attach to at least a portion of an outer surface of the mounting post.

4. The table apparatus of claim 1, wherein the mounting post comprises a recess configured to connectedly receive at least one utility device.

5. The table apparatus of claim 1, further comprising at least one spacer ring configured to slide onto the mounting post, wherein the at least one spacer ring adjusts the height of the table portion to accommodate a user's specific body type.

6. The table apparatus of claim 1, further comprising at least one edge stop assembly configured to attach to the table portion.

7. The table apparatus of claim 1, further comprising a knob set screw configured to connect to the vertical leg, wherein adjustment of the knob set screw increases or decreases the force required to rotate the table portion about the swing axis.

8. The table apparatus of claim 1, further comprising at least one cable management clip configured to detachably connect to the swing arm.

9. The table apparatus of claim 1, wherein the proximal end of the swing arm comprises an outer circumferential notch configured to rotatably connect to the horizontal leg.

10. The table apparatus of claim 9, further comprising a leveling set screw configured to connect to the horizontal leg and engage the outer circumferential notch.

11. A table apparatus, comprising:

a mounting bracket defining a swing axis, the mounting bracket configured to attach to a chair;

a swing arm including a proximal end and a distal end opposite the proximal end, the proximal end configured to rotatable connect to the mounting bracket about the swing axis, and the distal end defining a swivel axis;

a hinge including a first end and a second end, the first end configured to rotatably connect to the distal end of the swing arm about the swivel axis, and the second end defining a pitch axis substantially orthogonal to the swivel axis; and a table portion configured to rotatably connect to the second end of the hinge about the pitch axis;

a deck tilt mount having an upper portion and a lower portion, the upper portion configured to connect to the table portion and the lower portion configured to rotatably connect to the hinge about the pitch axis; and at least one set screw configured to connect to the lower portion, wherein adjustment of the set screw increases or decreases the force necessary to rotate the table portion about the pitch axis.

12. A chair assembly, comprising:

a chair;

a mounting bracket defining a swing axis, the mounting bracket attached to the chair;

a mounting post connected to the mounting bracket about the swing axis;

an elbow having a vertical leg and a horizontal leg, the vertical leg rotatably connected to the mounting post about the swing axis;

a swing arm including a proximal end and a distal end opposite the proximal end, the proximal end rotatably connected to the horizontal leg of the elbow, and the distal end defining a swivel axis;

a hinge including a first end and a second end, the first end rotatably connected to the distal end of the swing arm about the swivel axis, and the second end defining a pitch axis substantially orthogonal to the swivel axis; and a table portion rotatably connected to the second end of the hinge about the pitch axis, wherein the table portion is pitchable between a first table position and a second table position.

13. The chair assembly of claim 12, wherein the chair is adjustable between a first chair position and a second chair position reclined relative to the first chair position, and wherein the first table position corresponds to the first chair position and the second table position corresponds to the second chair position.

14. A method of using a table apparatus having a mounting bracket defining a swing axis attached to a chair, a mounting post connected to the mounting bracket about the swing axis, an elbow having a vertical leg and a horizontal leg, the vertical leg rotatably connected to the mounting post about the swing axis, a swing arm including a proximal end rotatably attached to the horizontal leg of the elbow and a distal end defining a swivel axis, a hinge including a first end rotatably connected to the distal end of the swing arm about the swivel axis and a second end defining a pitch axis substantially orthogonal to the swivel axis, and a table portion rotatably connected to the second end of the hinge about the pitch axis, the method comprising positioning the table apparatus between a first position and a second position.

15. The method of claim 14, further comprising attaching a utility device to the mounting post.

16. The method of claim 14, further comprising:

placing a laptop having at least one cable on the table portion; and securing the at least one cable to a cable management clip detachably connected to the swing arm.

17. The method of claim 14, further comprising:

attaching at least one edge stop assembly to the table portion;

placing an object on the table portion; and abutting at least a portion of the object to the at least one edge stop assembly.

18. The method of claim 14, wherein positioning the table apparatus comprises swinging the table portion between the first position and the second position.

19. The method of claim 14, wherein positioning the table apparatus comprises swiveling the table portion between the first position and the second position.

20. The method of claim 14, further comprising placing an object on the table portion, and wherein positioning the table apparatus comprises adjusting the level of the table portion between the first position and the second position.

21. The method of claim 14, further comprising adjusting the chair between a first chair position and a second chair position reclined relative to the first chair position.

22. The method of claim 21, wherein positioning the table apparatus comprises pitching the table portion between the first position and the second position, and wherein the first position corresponds to the first chair position and the second position corresponds to the second chair position.

* * * * *